US010825285B2

(12) United States Patent
Caputo et al.

(10) Patent No.: US 10,825,285 B2
(45) Date of Patent: Nov. 3, 2020

(54) GAMING SYSTEM AND METHOD PROVIDING A SLOT GAME INCLUDING A SYMBOL GENERATOR MODIFICATION EVENT

(71) Applicant: IGT, Las Vegas, NV (US)

(72) Inventors: Scott A. Caputo, Fremont, CA (US); Leandro Basallo, San Francisco, CA (US); Jon M. Leupp, Orinda, CA (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/395,473

(22) Filed: Dec. 30, 2016

(65) Prior Publication Data

US 2017/0109963 A1 Apr. 20, 2017

Related U.S. Application Data

(63) Continuation of application No. 14/885,608, filed on Oct. 16, 2015, now Pat. No. 9,536,376, which is a continuation of application No. 13/794,081, filed on Mar. 11, 2013, now Pat. No. 9,177,448.

(51) Int. Cl.

| | |
|---|---|
| ***G07F 17/32*** | (2006.01) |
| ***G07F 17/34*** | (2006.01) |
| ***G07F 17/42*** | (2006.01) |

(52) U.S. Cl.

CPC ..... *G07F 17/3213* (2013.01); *G07F 17/32* (2013.01); *G07F 17/326* (2013.01); *G07F 17/3209* (2013.01); *G07F 17/3227* (2013.01); *G07F 17/3244* (2013.01); *G07F 17/3267* (2013.01); *G07F 17/34* (2013.01); *G07F 17/42* (2013.01)

(58) Field of Classification Search

CPC ... G07F 17/3267; G07F 17/3244; G07F 17/34
See application file for complete search history.

(56) References Cited

U.S. PATENT DOCUMENTS

| | | | |
|---|---|---|---|
| 4,200,291 | A | 4/1980 | Hooker |
| 4,618,150 | A | 10/1986 | Kimura et al. |
| 4,624,459 | A | 11/1986 | Kaufman et al. |
| 4,732,386 | A | 3/1988 | Rayfiel |
| 4,756,531 | A | 7/1988 | Dire et al. |
| 4,790,537 | A | 12/1988 | Smyth et al. |

(Continued)

*Primary Examiner* — Omkar A Deodhar

(74) *Attorney, Agent, or Firm* — Neal, Gerber & Eisenberg LLP

(57) ABSTRACT

Various embodiments of the present disclosure are directed to a gaming system and method providing a slot game including a symbol generator modification event. In various embodiments, the gaming system is configured to provide a slot game, each play of which employs a subset of a plurality of symbol generators. If a symbol generator modification event occurs in association with a first play that employs a first subset of the symbol generators, the gaming system removes one of the symbol generators from the first subset and adds another one of the plurality of symbol generators to the first subset to form a second subset, and employs the second subset for a second play. The gaming system removes and adds the symbol generators to form the second subset such that the average expected payback percentage of the second play is greater than the average expected payback percentage of the first play.

14 Claims, 19 Drawing Sheets

(56) References Cited

U.S. PATENT DOCUMENTS 4,805,907 A 2/1989 Hagiwara
4,826,169 A 5/1989 Bessho et al.
4,838,552 A 6/1989 Hagiwara
4,874,173 A 10/1989 Kishishita et al.
4,978,129 A 12/1990 Komeda et al.
5,085,436 A 2/1992 Bennett
5,098,107 A 3/1992 Boylan et al.
5,123,649 A 6/1992 Tiberio
5,152,529 A 10/1992 Okada
5,178,390 A 1/1993 Okada
5,205,555 A 4/1993 Hamano
5,248,142 A 9/1993 Breeding et al.
5,364,100 A 11/1994 Ludlow et al.
5,393,057 A 2/1995 Marvell et al.
5,393,061 A 2/1995 Manship et al.
5,395,111 A 3/1995 Inoue
5,397,125 A 3/1995 Adams et al.
5,423,539 A 6/1995 Nagao
5,449,173 A 9/1995 Thomas et al.
5,456,465 A 10/1995 Durham
5,494,287 A 2/1996 Manz
5,511,781 A 4/1996 Wood et al.
5,542,669 A 8/1996 Charron et al.
5,569,084 A 10/1996 Nicastro et al.
5,580,053 A 12/1996 Crouch
5,580,055 A 12/1996 Hagiwara
5,580,309 A 12/1996 Piechowiak et al.
5,584,764 A 12/1996 Inoue
5,609,524 A 3/1997 Inoue et al.
5,611,535 A 3/1997 Tiberio
5,697,843 A 12/1997 Manship et al.
5,704,835 A 1/1998 Dietz
5,711,525 A 1/1998 Breeding et al.
5,722,891 A 3/1998 Inoue
5,752,881 A 5/1998 Inoue
5,766,074 A 6/1998 Cannon et al.
5,769,716 A 6/1998 Saffari et al.
5,772,509 A 6/1998 Weiss et al.
5,775,692 A 7/1998 Watts et al.
5,788,573 A 8/1998 Baerlocher et al.
5,816,918 A 10/1998 Kelly et al.
5,823,874 A 10/1998 Adams et al.
5,823,879 A 10/1998 Goldberg et al.
5,833,537 A 11/1998 Barrie
5,833,538 A 11/1998 Weiss
5,848,932 A 12/1998 Adams et al.
5,851,148 A 12/1998 Brune et al.
5,855,514 A 1/1999 Kamille et al.
5,863,249 A 1/1999 Inoue
5,873,781 A 2/1999 Keane et al.
5,876,284 A 3/1999 Acres et al.
5,882,261 A 3/1999 Adams et al.
5,890,962 A 4/1999 Takemoto et al.
5,934,672 A 8/1999 Sines et al.
5,947,820 A 9/1999 Mono et al.
5,951,397 A 9/1999 Dickinson
5,967,893 A 10/1999 Lawrence et al.
5,976,016 A 11/1999 Moody et al.
5,980,384 A 11/1999 Barrie
5,984,781 A 11/1999 Sunaga
5,984,782 A 11/1999 Inoue
5,993,316 A 11/1999 Coyle et al.
5,997,400 A 12/1999 Seelig et al.
5,997,401 A 12/1999 Crawford
6,012,982 A 1/2000 Piechowiak et al.
6,012,983 A 1/2000 Walker et al.
6,015,346 A 1/2000 Bennett
6,019,369 A 2/2000 Nakagawa et al.
6,033,307 A 3/2000 Vancura et al.
6,056,642 A 5/2000 Bennett
6,059,289 A 5/2000 Vancura et al.
6,062,980 A 5/2000 Luciano
6,062,981 A 5/2000 Luciano
6,068,552 A 5/2000 Walker et al.
6,086,066 A 7/2000 Takeuchi et al.
6,089,976 A 7/2000 Schneider et al.
6,089,978 A 7/2000 Adams
6,093,102 A 7/2000 Bennett et al.
6,095,921 A 8/2000 Walker et al.
6,102,798 A 8/2000 Bennett
6,109,610 A 8/2000 Cherry et al.
6,110,041 A 8/2000 Walker et al.
6,120,377 A 9/2000 McGinnis et al.
6,120,378 A 9/2000 Moody et al.
6,123,333 A 9/2000 McGinnis et al.
6,126,541 A 10/2000 Fuchs et al.
6,126,542 A 10/2000 Fier
6,142,873 A 11/2000 Weiss et al.
6,142,874 A 11/2000 Kodachi et al.
6,142,875 A 11/2000 Kodachi et al.
6,146,270 A 11/2000 Huard et al.
6,155,925 A 12/2000 Giobbi et al.
6,159,096 A 12/2000 Yoseloff
6,159,097 A 12/2000 Gura et al.
6,159,098 A 12/2000 Slomiany et al.
6,162,121 A 12/2000 Morro et al.
6,168,520 B1 1/2001 Baerlocher et al.
6,168,522 B1 1/2001 Walker et al.
6,168,523 B1 1/2001 Piechowiak et al.
6,174,233 B1 1/2001 Sunaga et al.
6,174,234 B1 1/2001 Seibert, Jr. et al.
6,186,894 B1 2/2001 Mayeroff
6,190,254 B1 2/2001 Bennett
6,190,255 B1 2/2001 Thomas et al.
6,200,217 B1 3/2001 Osawa
6,203,429 B1 3/2001 Demar et al.
6,203,430 B1 3/2001 Walker et al.
6,210,277 B1 4/2001 Stefan
6,217,022 B1 4/2001 Astaneha
6,224,483 B1 5/2001 Mayeroff
6,227,971 B1 5/2001 Weiss
6,231,445 B1 5/2001 Acres
6,234,897 B1 5/2001 Frohm et al.
6,238,287 B1 5/2001 Komori et al.
6,244,957 B1 6/2001 Walker et al.
6,251,013 B1 6/2001 Bennett
6,261,178 B1 7/2001 Bennett
6,270,409 B1 8/2001 Shuster
6,270,412 B1 8/2001 Crawford et al.
6,279,902 B1 8/2001 Yamazaki et al.
6,283,855 B1 9/2001 Bingham
6,290,600 B1 9/2001 Glasson
6,290,603 B1 9/2001 Luciano, Jr.
6,302,791 B1 10/2001 Frohm et al.
6,309,300 B1 10/2001 Glavich
6,311,976 B1 11/2001 Yoseloff et al.
6,312,334 B1 11/2001 Yoseloff
6,315,663 B1 11/2001 Sakamoto
6,322,309 B1 11/2001 Thomas et al.
6,328,649 B1 12/2001 Randall et al.
6,334,814 B1 1/2002 Adams
6,336,862 B1 1/2002 Byrne
6,346,043 B1 2/2002 Colin et al.
6,347,996 B1 2/2002 Gilmore et al.
6,358,147 B1 3/2002 Jaffe et al.
6,364,314 B1 4/2002 Canterbury
6,364,767 B1 4/2002 Brossard et al.
6,375,570 B1 4/2002 Poole
6,379,245 B2 4/2002 De Keller
6,394,902 B1 5/2002 Glavich et al.
6,398,218 B1 6/2002 Vancura
6,398,220 B1 6/2002 Inoue
6,413,161 B1 7/2002 Baerlocher et al.
6,413,162 B1 7/2002 Baerlocher et al.
6,419,579 B1 7/2002 Bennett
6,428,412 B1 8/2002 Anderson et al.
6,439,995 B1 8/2002 Hughs-Baird et al.
6,443,452 B1 9/2002 Brune
6,443,837 B1 9/2002 Jaffe et al.
6,461,241 B1 10/2002 Webb et al.
6,464,581 B1 10/2002 Yoseloff et al.
6,468,156 B1 10/2002 Hughs-Baird et al.
6,471,208 B2 10/2002 Yoseloff et al.
6,491,584 B2 12/2002 Graham et al.

(56) References Cited

U.S. PATENT DOCUMENTS 6,494,454 B2 12/2002 Adams
6,494,785 B1 12/2002 Gerrard et al.
6,506,118 B1 1/2003 Baerlocher et al.
6,514,141 B1 2/2003 Kaminkow et al.
6,517,432 B1 2/2003 Jaffe
6,537,150 B1 3/2003 Luciano et al.
6,544,120 B2 * 4/2003 Ainsworth ..... G07F 17/3244 273/138.2
6,547,242 B1 4/2003 Sugiyama et al.
6,551,187 B1 4/2003 Jaffe
6,561,899 B2 5/2003 Vancura
6,561,900 B1 5/2003 Baerlocher et al.
6,565,436 B1 5/2003 Baerlocher
6,569,013 B1 5/2003 Taylor
6,569,015 B1 5/2003 Baerlocher et al.
6,569,016 B1 5/2003 Baerlocher
6,575,830 B2 6/2003 Baerlocher et al.
6,582,306 B1 6/2003 Kaminkow
6,585,591 B1 7/2003 Baerlocher et al.
6,589,114 B2 7/2003 Rose
6,595,854 B2 7/2003 Hughs-Baird et al.
6,599,192 B1 7/2003 Baerlocher et al.
6,602,137 B2 8/2003 Kaminkow et al.
6,604,740 B1 8/2003 Singer et al.
6,604,999 B2 8/2003 Ainsworth
6,605,002 B2 8/2003 Baerlocher
6,607,438 B2 8/2003 Baerlocher et al.
6,609,971 B2 8/2003 Vancura
6,609,972 B2 8/2003 Seelig et al.
6,612,927 B1 9/2003 Slomiany et al.
6,616,142 B2 9/2003 Adams
6,620,045 B2 9/2003 Berman et al.
6,632,139 B1 10/2003 Baerlocher
6,632,141 B2 10/2003 Webb et al.
6,634,945 B2 10/2003 Glavich et al.
6,648,754 B2 11/2003 Baerlocher et al.
6,648,759 B2 11/2003 Vancura
6,659,864 B2 12/2003 McGahn et al.
6,676,512 B2 1/2004 Fong et al.
6,688,977 B1 2/2004 Baerlocher et al.
6,692,355 B2 2/2004 Baerlocher et al.
6,702,675 B2 3/2004 Poole et al.
6,712,693 B1 3/2004 Hettinger
6,712,694 B1 3/2004 Nordman
6,715,756 B2 4/2004 Inoue
6,719,632 B2 4/2004 Palmer et al.
6,722,981 B2 4/2004 Kaminkow et al.
6,722,982 B2 4/2004 Kaminkow et al.
6,726,204 B2 4/2004 Inoue
6,733,386 B2 5/2004 Cuddy et al.
6,758,750 B2 7/2004 Baerlocher et al.
6,776,711 B1 8/2004 Baerlocher
6,786,820 B2 9/2004 Gerrard et al.
6,793,579 B2 9/2004 Baerlocher et al.
6,796,901 B2 9/2004 Baerlocher
6,796,905 B2 9/2004 Baerlocher et al.
6,802,778 B1 10/2004 Lemay et al.
6,808,452 B2 10/2004 Baerlocher et al.
6,808,454 B2 10/2004 Gerrard et al.
6,811,483 B1 11/2004 Webb et al.
6,811,485 B2 11/2004 Kaminkow
6,832,957 B2 12/2004 Falconer
6,852,030 B2 2/2005 Baerlocher
6,855,056 B2 2/2005 Inoue
6,857,958 B2 2/2005 Osawa
6,866,583 B2 3/2005 Glavich et al.
6,869,357 B2 3/2005 Adams
6,875,108 B1 4/2005 Hughs-Baird
6,880,826 B2 4/2005 Inoue
6,890,257 B2 5/2005 Baerlocher
6,893,018 B2 5/2005 Inoue
6,896,617 B2 5/2005 Daly
6,899,623 B2 5/2005 Baerlocher
6,905,406 B2 6/2005 Kaminkow et al.
6,913,532 B2 7/2005 Baerlocher et al.
6,942,566 B2 9/2005 Baerlocher et al.
6,942,567 B2 9/2005 Baerlocher et al.
6,955,600 B2 10/2005 Glavich et al.
6,960,132 B2 11/2005 Baerlocher et al.
6,960,133 B1 11/2005 Marks et al.
6,966,833 B2 11/2005 Kaminkow et al.
6,971,953 B2 12/2005 Gerrard et al.
6,971,955 B2 12/2005 Baerlocher et al.
6,979,263 B2 12/2005 Baerlocher et al.
7,001,273 B2 2/2006 Baerlocher
7,001,274 B2 2/2006 Baerlocher et al.
7,014,560 B2 3/2006 Glavich et al.
7,029,395 B1 4/2006 Baerlocher
7,040,984 B2 5/2006 Mead
7,052,395 B2 5/2006 Glavich et al.
7,056,213 B2 6/2006 Ching et al.
7,066,814 B2 6/2006 Glavich et al.
7,094,148 B2 8/2006 Baerlocher et al.
7,108,602 B2 9/2006 Daly
7,121,942 B2 10/2006 Baerlocher
7,131,908 B2 11/2006 Baerlocher
7,160,186 B2 1/2007 Cuddy et al.
7,172,506 B2 2/2007 Baerlocher et al.
7,192,349 B2 3/2007 Baerlocher et al.
7,198,569 B2 4/2007 Wolf et al.
7,235,010 B2 6/2007 Baerlocher
7,235,011 B2 6/2007 Randall et al.
7,238,110 B2 7/2007 Glavich et al.
7,241,220 B2 7/2007 Rothkranz et al.
7,250,001 B2 7/2007 Baerlocher et al.
7,258,611 B2 8/2007 Bigelow, Jr. et al.
7,264,545 B2 9/2007 Maya et al.
7,270,604 B2 9/2007 Gerrard et al.
7,275,989 B2 10/2007 Moody
7,322,887 B2 1/2008 Belger et al.
7,326,114 B2 2/2008 Webb et al.
7,329,179 B2 2/2008 Baerlocher
7,331,864 B2 2/2008 Baerlocher
7,331,867 B2 2/2008 Baerlocher et al.
7,351,144 B2 4/2008 Daly
7,364,507 B2 4/2008 Baerlocher et al.
7,381,134 B2 6/2008 Cuddy et al.
7,384,334 B2 6/2008 Glavich et al.
7,393,278 B2 7/2008 Gerson et al.
7,402,103 B2 7/2008 Baerlocher
7,407,435 B2 8/2008 Baerlocher et al.
7,419,429 B2 9/2008 Taylor
7,470,184 B2 12/2008 Baerlocher et al.
7,473,174 B2 1/2009 Cuddy et al.
7,481,708 B2 1/2009 Baerlocher et al.
7,507,155 B2 3/2009 Mead et al.
7,513,826 B2 4/2009 Cuddy
7,566,271 B2 7/2009 Hostetler et al.
7,572,183 B2 8/2009 Olivas et al.
7,601,062 B2 10/2009 Cole et al.
7,654,895 B2 2/2010 Pacey
7,666,083 B2 2/2010 Baerlocher et al.
7,682,246 B2 3/2010 Cregan et al.
7,690,982 B2 4/2010 Cuddy
7,690,986 B2 4/2010 Ching et al.
7,690,987 B2 4/2010 Baerlocher et al.
7,731,582 B2 6/2010 Randall et al.
7,731,584 B2 6/2010 Glavich et al.
7,749,063 B2 7/2010 Belger et al.
7,753,773 B2 7/2010 Baerlocher et al.
7,775,874 B2 8/2010 Ching et al.
7,789,747 B2 9/2010 Glavich et al.
7,806,760 B2 10/2010 Baerlocher
7,824,263 B2 11/2010 Baerlocher
7,828,648 B2 11/2010 Jackson
7,914,373 B2 3/2011 Webb et al.
7,914,376 B2 3/2011 Walker et al.
7,918,725 B2 4/2011 Baerlocher
7,922,573 B2 4/2011 Baerlocher et al.
7,927,204 B2 4/2011 DeBrabander, Jr. et al.
7,927,206 B2 4/2011 Baerlocher et al.
7,950,994 B2 5/2011 Berman et al.
7,993,195 B2 8/2011 Belger et al.
8,002,621 B2 8/2011 Mattice et al.

(56) References Cited

U.S. PATENT DOCUMENTS 8,137,179 B2 * 3/2012 Jensen ..... G07F 17/32 463/16
8,267,768 B2 9/2012 Taylor
8,317,597 B2 11/2012 Taylor
8,414,378 B2 * 4/2013 Okada ..... G07F 17/32 463/16
8,419,519 B2 4/2013 Aoki et al.
8,529,333 B2 9/2013 Berman et al.
9,330,527 B2 * 5/2016 Collette ..... G07F 17/326
2001/0046890 A1 11/2001 Ferguson
2001/0054794 A1 12/2001 Cole et al.
2002/0014740 A1 2/2002 Ainsworth
2002/0025844 A1 2/2002 Casey et al.
2002/0045475 A1 4/2002 Glavich et al.
2002/0055381 A1 5/2002 Tarantino
2002/0055382 A1 5/2002 Meyer
2002/0072402 A1 6/2002 Baerlocher
2002/0094857 A1 7/2002 Meyer
2002/0094861 A1 7/2002 Seelig et al.
2002/0094862 A1 7/2002 Inoue
2002/0142822 A1 10/2002 Baerlocher et al.
2002/0142829 A1 10/2002 Inoue
2002/0151350 A1 10/2002 Baerlocher et al.
2002/0155883 A1 10/2002 Baerlocher
2002/0187827 A1 12/2002 Blankstein
2002/0193158 A1 12/2002 Weiss et al.
2002/0193160 A1 12/2002 Tarantino
2003/0013514 A1 1/2003 Cregan et al.
2003/0013518 A1 1/2003 Graham
2003/0017865 A1 1/2003 Beaulieu et al.
2003/0027622 A1 2/2003 Osawa
2003/0036419 A1 2/2003 Baerlocher et al.
2003/0036422 A1 2/2003 Baerlocher et al.
2003/0036424 A1 2/2003 Baerlocher
2003/0040355 A1 2/2003 Baerlocher
2003/0040360 A1 2/2003 Kaminkow
2003/0045344 A1 3/2003 Webb et al.
2003/0045345 A1 3/2003 Berman
2003/0045348 A1 3/2003 Palmer et al.
2003/0045350 A1 3/2003 Baerlocher et al.
2003/0060260 A1 3/2003 Gerrard et al.
2003/0064795 A1 4/2003 Baerlocher et al.
2003/0078093 A1 4/2003 Simms et al.
2003/0087693 A1 5/2003 Baerlocher et al.
2003/0092480 A1 5/2003 White et al.
2003/0157982 A1 8/2003 Gerrard et al.
2003/0162579 A1 8/2003 Gauselmann
2003/0162584 A1 8/2003 Hughs-Baird et al.
2003/0203752 A1 10/2003 Kaminkow et al.
2003/0207713 A1 11/2003 Taylor
2003/0216165 A1 11/2003 Singer et al.
2003/0232643 A1 12/2003 Inoue
2004/0000754 A1 1/2004 Inoue
2004/0009803 A1 1/2004 Bennett et al.
2004/0009805 A1 1/2004 Baerlocher et al.
2004/0012145 A1 1/2004 Inoue
2004/0014516 A1 1/2004 Inoue
2004/0014517 A1 1/2004 Inoue
2004/0017041 A1 1/2004 Inoue
2004/0018866 A1 1/2004 Inoue
2004/0023707 A1 2/2004 Maya et al.
2004/0023713 A1 2/2004 Wolf et al.
2004/0023714 A1 2/2004 Asdale
2004/0023715 A1 2/2004 Luciano, Jr. et al.
2004/0026854 A1 2/2004 Inoue
2004/0036218 A1 2/2004 Inoue
2004/0038724 A1 2/2004 Asdale
2004/0038726 A1 2/2004 Inoue
2004/0038729 A1 2/2004 Webb et al.
2004/0041340 A1 3/2004 Inoue
2004/0048650 A1 3/2004 Mierau et al.
2004/0053658 A1 3/2004 Rothranz
2004/0053687 A1 3/2004 Nordman et al.
2004/0058727 A1 3/2004 Marks et al.
2004/0097280 A1 5/2004 Gauselmann
2004/0106444 A1 6/2004 Cuddy et al.
2004/0121840 A1 6/2004 Rosander et al.
2004/0155399 A1 8/2004 Inoue
2004/0162128 A1 8/2004 Baerlocher et al.
2004/0162134 A1 * 8/2004 Walker ..... G07F 17/32 463/20
2004/0180710 A1 9/2004 Palmer et al.
2004/0183251 A1 9/2004 Inoue
2004/0185928 A1 9/2004 Baerlocher et al.
2004/0192431 A1 9/2004 Singer et al.
2004/0195773 A1 10/2004 Masci et al.
2004/0214628 A1 10/2004 Boyd et al.
2004/0214632 A1 10/2004 Cuddy et al.
2004/0224745 A1 11/2004 Bregenzer
2004/0242313 A1 12/2004 Munoz
2004/0242314 A1 12/2004 Casey
2005/0009597 A1 1/2005 Daly
2005/0020342 A1 1/2005 Palmer et al.
2005/0020346 A1 1/2005 Baerlocher
2005/0032567 A1 2/2005 Baerlocher et al.
2005/0037829 A1 2/2005 Baerlocher et al.
2005/0043083 A1 2/2005 Inoue
2005/0043084 A1 2/2005 Inoue
2005/0049036 A1 3/2005 Mead
2005/0054413 A1 3/2005 Randall et al.
2005/0054416 A1 3/2005 Hostetler et al.
2005/0054429 A1 3/2005 Baerlocher et al.
2005/0055115 A1 3/2005 Gerrard et al.
2005/0059477 A1 3/2005 Baerlocher
2005/0059478 A1 3/2005 Peterson et al.
2005/0060050 A1 3/2005 Baerlocher
2005/0071023 A1 3/2005 Gilliland et al.
2005/0096121 A1 5/2005 Gilliland et al.
2005/0096123 A1 5/2005 Cregan et al.
2005/0101375 A1 5/2005 Webb et al.
2005/0124406 A1 6/2005 Cannon
2005/0130729 A1 6/2005 Baerlocher et al.
2005/0143170 A1 6/2005 Maya et al.
2005/0159208 A1 * 7/2005 Pacey ..... G07F 17/3211 463/20
2005/0164774 A1 7/2005 Gauselmann
2005/0164777 A1 7/2005 Daly
2005/0187010 A1 8/2005 Baerlocher
2005/0192081 A1 9/2005 Marks et al.
2005/0197180 A1 9/2005 Kaminkow et al.
2005/0208992 A1 9/2005 Randall
2005/0239539 A1 10/2005 Inamura
2005/0266914 A1 12/2005 Baerlocher et al.
2005/0277460 A1 12/2005 Inoue
2005/0282620 A1 12/2005 Marks et al.
2005/0282625 A1 12/2005 Nicely
2005/0288094 A1 12/2005 Marks et al.
2006/0003837 A1 1/2006 Baerlocher et al.
2006/0019738 A1 1/2006 Baerlocher et al.
2006/0025196 A1 2/2006 Webb et al.
2006/0040728 A1 2/2006 Fuller
2006/0040827 A1 2/2006 Rajamannan
2006/0046830 A1 3/2006 Webb
2006/0058097 A1 3/2006 Berman et al.
2006/0063580 A1 3/2006 Nguyen et al.
2006/0073872 A1 4/2006 B-Jensen et al.
2006/0084492 A1 4/2006 Baerlocher et al.
2006/0084498 A1 4/2006 Baerlocher et al.
2006/0111176 A1 5/2006 Kaminkow et al.
2006/0116196 A1 6/2006 Vancura
2006/0121966 A1 6/2006 Baerlocher
2006/0128457 A1 6/2006 Cannon
2006/0172791 A1 8/2006 Wolf
2007/0021182 A1 1/2007 Gauselmann
2007/0060246 A1 3/2007 Baerlocher et al.
2007/0060297 A1 3/2007 Hein et al.
2007/0087804 A1 4/2007 Knowles et al.
2007/0135207 A1 6/2007 Tarantino
2007/0155466 A1 7/2007 Baerlocher et al.
2007/0155474 A1 7/2007 Gauselmann
2007/0243921 A1 10/2007 Fanjoy et al.
2007/0275778 A1 11/2007 Fong et al.
2007/0281778 A1 12/2007 Bigelow et al.
2007/0287532 A1 12/2007 Jackson

(56) References Cited

U.S. PATENT DOCUMENTS

2007/0298872 A1 12/2007 Gerrard et al.
2008/0039184 A1 2/2008 Inamura
2008/0058090 A1 3/2008 Okada
2008/0076503 A1* 3/2008 Mattice ..... G07F 17/3244 463/16
2008/0076535 A1 3/2008 Baerlocher et al.
2008/0090636 A1 4/2008 Lathrop
2008/0102923 A1 5/2008 Esses et al.
2008/0108411 A1* 5/2008 Jensen ..... G07F 17/32 463/20
2008/0113760 A1 5/2008 Baerlocher
2008/0113779 A1 5/2008 Cregan
2008/0153584 A1 6/2008 Cuddy et al.
2008/0200232 A1 8/2008 Baerlocher et al.
2008/0200237 A1 8/2008 Cuddy et al.
2008/0214272 A1 9/2008 Baerlocher et al.
2008/0214292 A1 9/2008 Bryant et al.
2008/0220851 A1 9/2008 Glavich et al.
2009/0042652 A1* 2/2009 Baerlocher ..... G07F 17/32 463/42
2009/0069071 A1 3/2009 Aoki et al.
2009/0088239 A1 4/2009 Iddings et al.
2009/0104959 A1 4/2009 Caputo et al.
2009/0104977 A1 4/2009 Zielinski
2009/0104979 A1 4/2009 Ruymann
2009/0124325 A1 5/2009 Wadleigh et al.
2009/0124326 A1 5/2009 Caputo et al.
2009/0170592 A1 7/2009 Cuddy
2009/0227357 A1 9/2009 Rasmussen
2010/0004049 A1 1/2010 Ching et al.
2010/0004050 A1 1/2010 Caputo et al.
2010/0016055 A1 1/2010 Englman
2010/0022297 A1 1/2010 Saunders
2010/0029381 A1* 2/2010 Vancura ..... G07F 17/3244 463/30
2010/0120493 A1 5/2010 Hoffman et al.
2010/0120506 A1* 5/2010 Davis ..... G07F 17/3262 463/20
2010/0120507 A1 5/2010 Rodgers et al.
2010/0124970 A1 5/2010 Pawloski et al.
2010/0124972 A1 5/2010 Rodgers et al.
2010/0304831 A1 12/2010 Suda et al.
2010/0304835 A1* 12/2010 Okada ..... G07F 17/32 463/20
2011/0034236 A1 2/2011 Jackson
2011/0045894 A1 2/2011 Owen
2011/0086695 A1 4/2011 Evans
2011/0111824 A1 5/2011 Cuddy et al.
2011/0111825 A1 5/2011 Caputo
2011/0111826 A1 5/2011 Baerlocher et al.
2011/0118010 A1 5/2011 Brune
2011/0124395 A1 5/2011 Baerlocher et al.
2011/0130193 A1 6/2011 Belger et al.
2011/0190044 A1 8/2011 Berman et al.
2011/0223984 A1* 9/2011 Mizue ..... G07F 17/3265 463/20
2012/0083327 A1 4/2012 Zobel et al.
2012/0115570 A1* 5/2012 Collette ..... G07F 17/326 463/20
2012/0142409 A1* 6/2012 Kelly ..... G07F 17/3244 463/25
2012/0214580 A1* 8/2012 Hoffman ..... G07F 17/3244 463/27
2013/0102375 A1* 4/2013 Aoki ..... G07F 17/32 463/20
2013/0252711 A1* 9/2013 Dias Pires ..... G07F 17/32 463/21
2014/0011568 A1 1/2014 Berman et al.

* cited by examiner

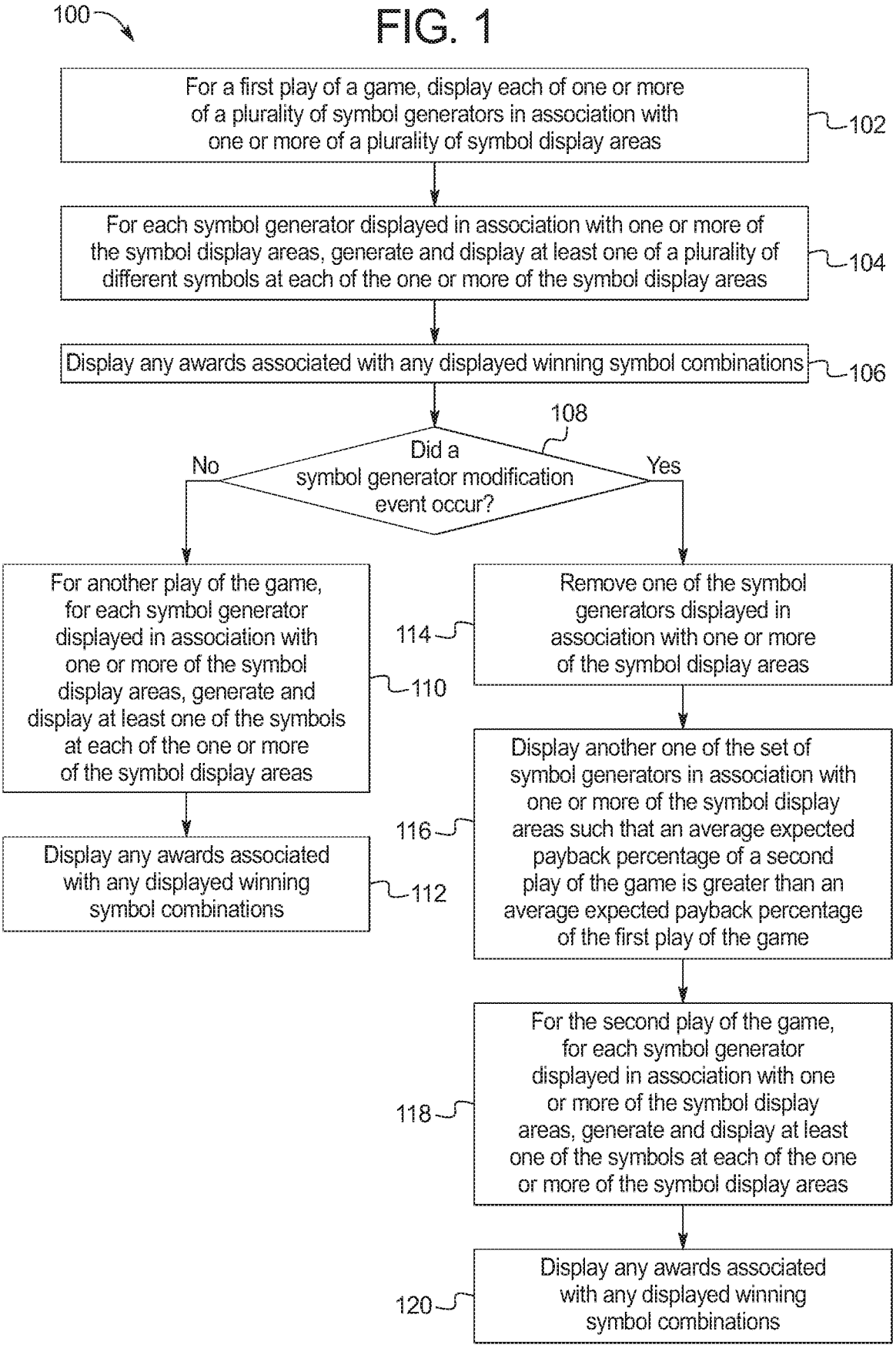
100
FIG. 1
For a first play of a game, display each of one or more of a plurality of symbol generators in association with one or more of a plurality of symbol display areas
102
For each symbol generator displayed in association with one or more of the symbol display areas, generate and display at least one of a plurality of different symbols at each of the one or more of the symbol display areas
104
Display any awards associated with any displayed winning symbol combinations
106
108
Did a symbol generator modification event occur?
No
Yes
For another play of the game, for each symbol generator displayed in association with one or more of the symbol display areas, generate and display at least one of the symbols at each of the one or more of the symbol display areas
110
Display any awards associated with any displayed winning symbol combinations
112
Remove one of the symbol generators displayed in association with one or more of the symbol display areas
114
Display another one of the set of symbol generators in association with one or more of the symbol display areas such that an average expected payback percentage of a second play of the game is greater than an average expected payback percentage of the first play of the game
116
For the second play of the game, for each symbol generator displayed in association with one or more of the symbol display areas, generate and display at least one of the symbols at each of the one or more of the symbol display areas
118
Display any awards associated with any displayed winning symbol combinations
120

GAMING SYSTEM AND METHOD PROVIDING A SLOT GAME INCLUDING A SYMBOL GENERATOR MODIFICATION EVENT

PRIORITY CLAIM

This application is a continuation of and claims priority to and the benefit of U.S. patent application Ser. No. 14/885,608, which was filed on Oct. 16, 2015, and issued as U.S. Pat. No. 9,536,376 on Jan. 3, 2017, which is a continuation of and claims priority to and the benefit of U.S. patent application Ser. No. 13/794,081, which was filed on Mar. 11, 2013, and issued as U.S. Pat. No. 9,177,448 on Nov. 3, 2015, the entire contents of each of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming systems, an amount of a wager placed on a primary game by a player may vary. For instance, a gaming system may enable a player to wager a minimum quantity of credits, such as one credit (e.g., one penny, nickel, dime, quarter, or dollar), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming machine may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Various players continually seek out new and different variations to gaming systems. A continuing need thus exists for gaming systems and methods that provide new, exciting, and engaging games.

SUMMARY

Various embodiments of the present disclosure are directed to a gaming system and method providing a slot game including a symbol generator modification event. Generally, in various embodiments, the gaming system is configured to provide a plurality of plays of a slot game, each of which employs a subset of a set of a plurality of symbol generators. If a symbol generator modification event occurs in association with a first one of the plays of the slot game that employs a first subset of the set of symbol generators, the gaming system removes one of the symbol generators from the first subset, adds another one of the symbol generators of the set to the first subset to form a second different subset, and employs the second subset for a second one of the plays of the slot game. The gaming system removes and adds the symbol generators to form the second subset such that the average expected payback percentage of the second one of the plays of the slot game is greater than the average expected payback percentage of the first one of the plays of the slot game.

More specifically, in one embodiment, the gaming system is configured to operate a slot game associated with a set of a plurality of symbol generators and a plurality of different symbols. For a first play of the slot game, the gaming system displays each of one or more of the symbol generators of the set in association with one or more of a plurality of symbol display areas. For each symbol generator displayed in association with one or more of the symbol display areas, the gaming system generates and displays at least one of the symbols at each of the one or more of the symbol display areas. The gaming system displays any awards associated with any displayed winning symbol combinations. The gaming system determines whether a symbol generator modification event occurred. If the gaming system determines that the symbol generator modification event did not occur, for another play of the game, for each symbol generator displayed in association with one or more of the symbol display areas, the gaming system generates and displays at least one of the symbols at each of the one or more of the symbol display areas. The gaming system displays any awards associated with any displayed winning symbol combinations.

If, on the other hand, the gaming system determines that the symbol generator modification event occurred, the gaming system removes one of the symbol generators displayed in association with one or more of the symbol display areas. The gaming system displays another one of the symbol generators of the set in association with one or more of the symbol display areas such that an average expected payback percentage of a second play of the game is greater than an average expected payback percentage of the first play of the game. For the second play of the game, for each symbol generator displayed in association with one or more of the symbol display areas, the gaming system generates and displays at least one of the symbols at each of the one or more of the symbol display areas. The gaming system displays any awards associated with any displayed winning symbol combinations.

It should thus be appreciated that the gaming system and method of the present disclosure incorporate new and different ways of determining which reels to employ for a play of a slot game to vary the average expected payback percentage, thereby increasing player enjoyment, entertainment, and excitement.

Additional features and advantages are described herein, and will be apparent from, the following Detailed Description and the Figures.

BRIEF DESCRIPTION OF THE FIGURES

FIG. 1 is a flowchart illustrating a method of operating an example embodiment of the gaming system of the present disclosure.

DETAILED DESCRIPTION

Figure 2A:
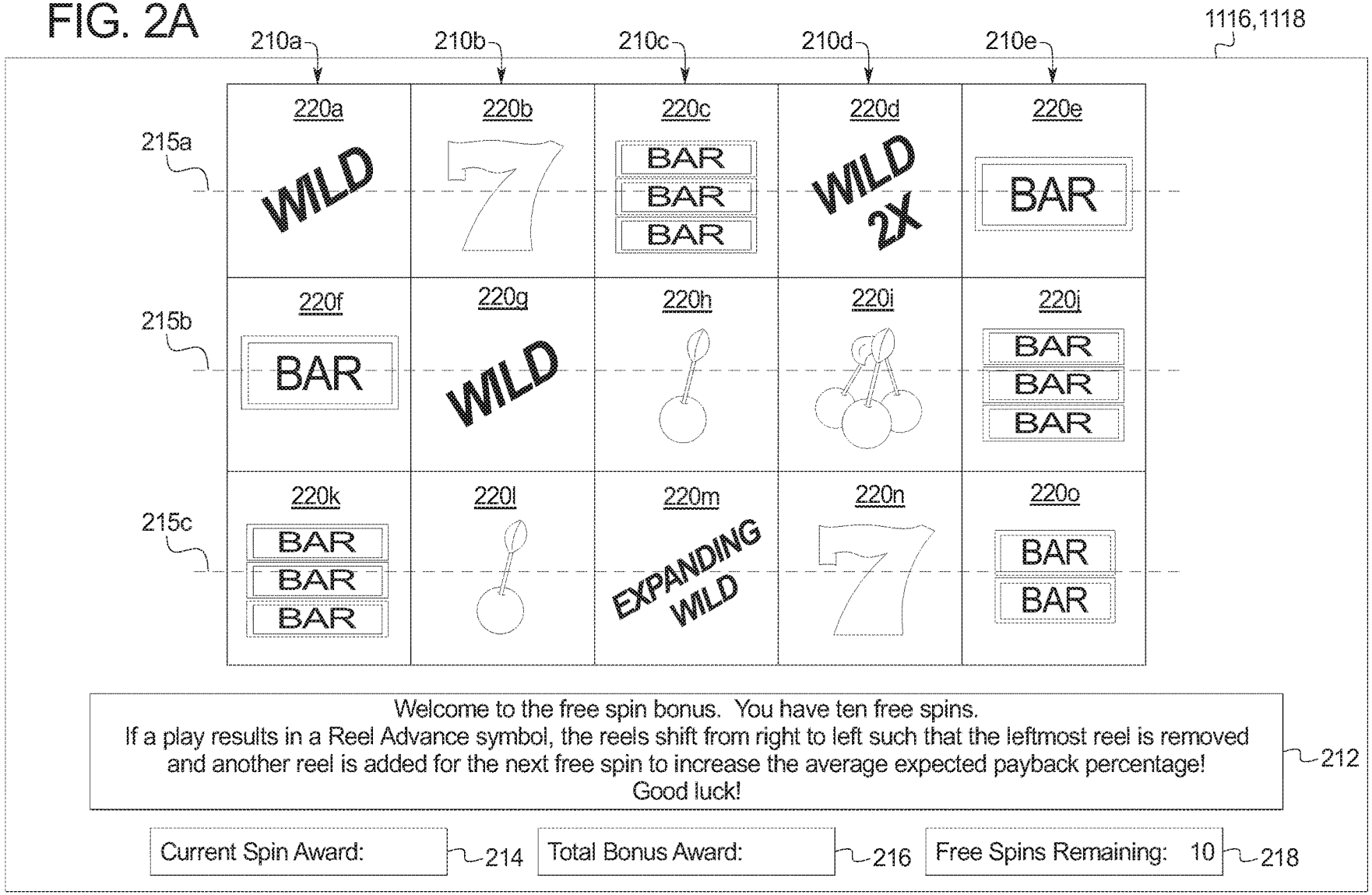
FIGS. 2A, 2B, 2C, 2D, 2E, 2F, 2G, 2H, 2I, 2J, 2K, 2L, 2M, and 2N illustrate screen shots of the gaming system of the present disclosure operating a free spin bonus including a plurality of free spins of the reels of an example of the slot game of the present disclosure.

Slot Game Including a Symbol Generator Modification Event

Various embodiments of the present disclosure are directed to a gaming system and method providing a slot game including a symbol generator modification event. While the slot game of the present disclosure is provided as or in association with a bonus game or event in the embodiments described below, it should be appreciated that the slot game may additionally or alternatively be employed as or in association with a primary game or a secondary game. Moreover, while any credit balances, any wagers, and any awards are displayed as amounts of monetary credits or currency in the embodiments described below, one or more of such credit balances, such wagers, and such awards may be for non-monetary credits, promotional credits, and/or player tracking points or credits.

FIG. 1 illustrates a flowchart of an example process or method 100 of operating the gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In this example, the gaming system is configured to operate a slot game associated with a set of a plurality of symbol generators and a plurality of different symbols. For a first play of the slot game, the gaming system displays each of one or more of the symbol generators of the set in association with one or more of a plurality of symbol display areas, as indicated by block 102. For each symbol generator displayed in association with one or more of the symbol display areas, the gaming system generates and displays at least one of the symbols at each of the one or more of the symbol display areas, as indicated by block 104. The gaming system displays any awards associated with any displayed winning symbol combinations, as indicated by block 106.

The gaming system determines whether a symbol generator modification event occurred, as indicated by diamond 108. If the gaming system determines that the symbol generator modification event did not occur, for another play of the game, for each symbol generator displayed in association with one or more of the symbol display areas, the gaming system generates and displays at least one of the symbols at each of the one or more of the symbol display areas, as indicated by block 110. The gaming system displays any awards associated with any displayed winning symbol combinations, as indicated by block 112.

If, on the other hand, the gaming system determines that the symbol generator modification event occurred, the gaming system removes one of the symbol generators displayed in association with one or more of the symbol display areas, as indicated by block 114. The gaming system displays another one of the symbol generators of the set in association with one or more of the symbol display areas such that an average expected payback percentage of a second play of the game is greater than an average expected payback percentage of the first play of the game, as indicated by block 116. For the second play of the game, for each symbol generator displayed in association with one or more of the symbol display areas, the gaming system generates and displays at least one of the symbols at each of the one or more of the symbol display areas, as indicated by block 118. The gaming system displays any awards associated with any displayed winning symbol combinations, as indicated by block 120.

FIGS. 2A, 2B, 2C, 2D, 2E, 2F, 2G, 2H, 2I, 2J, 2K, 2L, 2M, and 2N illustrate screen shots of the gaming system of the present disclosure operating a free spin bonus including a plurality of free spins of the reels of an example of the slot game of the present disclosure. The gaming system displays (such as on display device 1116 or 1118, described below) a plurality of symbol display areas 220*a*, 220*b*, 220*c*, 220*d*, 220*e*, 220*f*, 220*g*, 220*h*, 220*i*, 220*j*, 220*k*, 220*l*, 220*m*, 220*n*, and 220*o* arranged in a 3×5 matrix. The gaming system displays a plurality of paylines, each of which is associated with a different plurality of the symbol display areas. In this example, payline 215*a* is associated with symbol display areas 220*a*, 220*b*, 220*c*, 220*d*, and 220*e*; payline 215*b* is associated with symbol display areas 220*f*, 220*g*, 220*h*, 220*i*, and 220*j*; and payline 215*c* is associated with symbol display areas 220*k*, 220*l*, 220*m*, 220*n*, and 220*o*.

In this example, the slot game is associated with a set or pool of a plurality of reels, each of which includes a plurality of symbols. For each free spin, the gaming system employs a subset of the set of reels including a plurality of, but fewer than all of, the set of reels. Upon initiation of the free spin bonus, the gaming system displays a first subset of the set of reels including reels 210*a*, 210*b*, 210*c*, 210*d*, and 210*e* from left to right, and employs the first subset of the set of reels for at least the first free spin, as described below. The gaming system displays each of the reels of the first subset of the set of reels in association with one or more of the symbol display areas. Specifically, in this example, the gaming system displays: (a) reel 210*a* in association with symbol display areas 220*a*, 220*f*, and 220*k*; reel 210*b* in association with symbol display areas 220*b*, 220*g*, and 220*l*; reel 210*c* in association with symbol display areas 220*c*, 220*h*, and 220*m*; reel 210*d* in association with symbol display areas 220*d*, 220*i*, and 220*n*; and reel 210*e* in association with symbol display areas 220*e*, 220*j*, and 220*o*.

It should be appreciated that the set of reels may include any suitable quantity of reels, and that the quantity of reels included in the set may be determined in any suitable manner(s) or based on any suitable factor(s). In one example, the quantity of reels in the set is determined based on a wager placed by the player on the play of the primary wagering game that triggered the free spin bonus such that the higher the wager, the more reels are included in the set. It should also be appreciated that which reels are included in the set may be determined in any suitable manner. In one example, the gaming system employs a predetermined set of reels or one of a plurality of predetermined sets of reels. In another example, the gaming system dynamically generates which reels to include in the set of reels either before play of the free spin bonus or as reels are removed (as described below).

In this example, each of the plurality of reels of the set is associated with at least one of a plurality of different features or characteristics. Here: (a) reels 210*a* and 210*b* each include at least one Wild symbol; (b) reel 210*c* includes at least one Expanding Wild symbol that, when generated and displayed for one of the free spins, causes the gaming system to convert any other symbols generated and displayed on the same reel (i.e., reel 210*c*) into a Wild symbol; (c) reel 210*d* includes at least one 2× Wild symbol that functions as both a Wild symbol and a 2× multiplier; and (d) reel 210*e* includes at least one Reel Advance symbol.

In this example, a reel modification event occurs when the gaming system generates and displays a designated quantity of one instance of the Reel Advance symbol for one of the free spins. When the reel modification event occurs in association with one of the free spins, the gaming system modifies the subset of the set of reels employed for that free spin and employs the modified subset of the set of reels for at least the subsequent free spin (if any). In this example, the gaming system employs the modified subset of the set of reels for each subsequent free spin (if any) unless and until the reel modification event occurs in association with one of any subsequent free spins.

More specifically, in this example, upon the occurrence of the reel modification event in association with a first free spin that employs a first subset of the set of reels, the gaming system modifies the first subset of the set of reels by: (a) removing the leftmost reel, (b) shifting the remaining displayed reels from right to left (or in any other suitable direction), and (c) displaying another one of the reels of the set adjacent to the rightmost reel to create a second different subset of the set of reels. In this example, the gaming system employs the second subset of the set of reels for each subsequent free spin (if any) unless and until the reel modification event occurs in association with one of any subsequent free spins.

It should be appreciated that the average expected payback percentage of each subsequent free spin employing the second subset of the set of reels is greater than the average expected payback percentage of any previous spins employing the first subset of the set of reels. More specifically, the shift in position of the displayed reels after the leftmost reel was removed and before the new reel was added and/or the feature or characteristic associated with the newly added reel cause the average expected payback percentage of the subsequent free spins employing the second subset of the set of reels to be greater than the average expected payback percentage of the previous spins employing the first subset of the set of reels. Thus, the more the reel modification event occurs during the free spin bonus, the higher the average expected payback percentage of the free spins.

In other embodiments, instead of or in addition to increasing the average expected payback percentage of at least one subsequent free spin employing the second subset of the set of reels, the gaming system modifies the subset of the set of reels such that the volatility of at least one subsequent free spin employing the second subset of the set of reels increases or decreases. For instance, upon the occurrence of the reel modification event, the gaming system removes one of the displayed reels and adds another one of the reels of the set such that a previously unavailable jackpot award is available to be won in at least one subsequent free spin.

The gaming system also displays a plurality of displays or meters, including: a Current Spin Award Meter 214 that displays any awards for the current free spin; a Total Bonus Award Meter 216 that displays the sum of any awards won during the free spin bonus; a Free Spins Remaining Meter 218 that displays the quantity of free spins remaining in the free spin bonus; and a message box 212 that displays messages or indications before, during, or after play of the slot game. While in this illustrated example the gaming system indicates any awards in the form of amounts of credits, it should be appreciated that such indications may alternatively or additionally be made in the form of amounts of currency.

As illustrated in FIG. 2A, upon an occurrence of a bonus triggering event in association with a play of a primary game (not shown), the gaming system initiates the free spin bonus, which includes a quantity of ten free spins (i.e., plays of the slot game in this example). The gaming system displays the remaining quantity of ten free spins in Free Spins Remaining Meter 218. The gaming system displays the following message in message box 212: "WELCOME TO THE FREE SPIN BONUS. YOU HAVE TEN FREE SPINS. IF A PLAY RESULTS IN A REEL ADVANCE SYMBOL, THE REELS SHIFT FROM RIGHT TO LEFT SUCH THAT THE LEFTMOST REEL IS REMOVED AND ANOTHER REEL IS ADDED FOR THE NEXT FREE SPIN TO INCREASE THE AVERAGE EXPECTED PAYBACK PERCENTAGE! GOOD LUCK!"

Figure 2B:
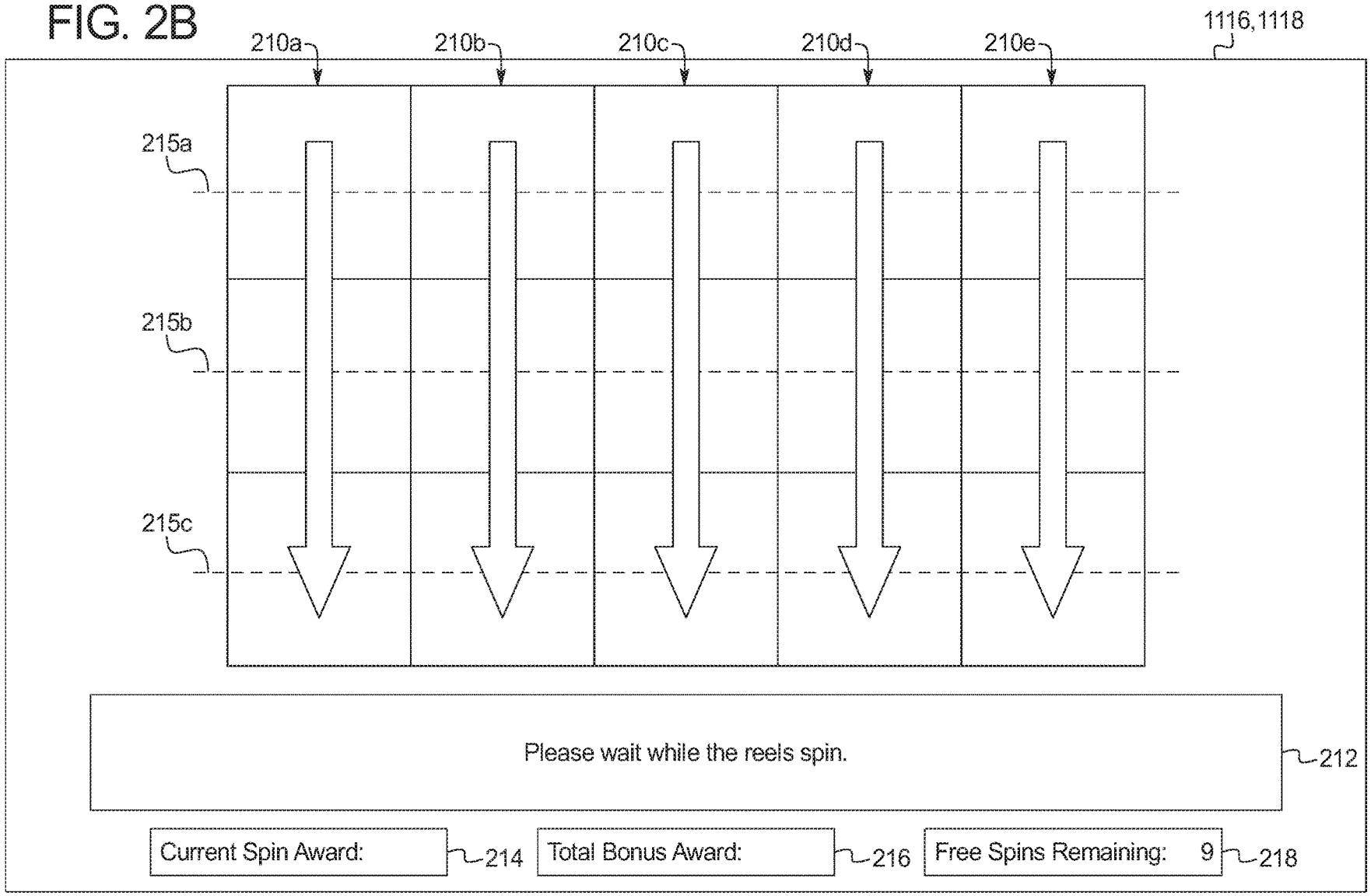

As illustrated in FIG. 2B, the gaming system initiates the first free spin, which employs the first subset of the set of reels including reels 210*a*, 210*b*, 210*c*, 210*d*, and 210*e*, and displays each of the reels spinning. The gaming system reduces the remaining quantity of free spins by one, and updates Free Spins Remaining Meter 218 accordingly. The gaming system displays the following message in message box 212: "PLEASE WAIT WHILE THE REELS SPIN."

Figure 2C:
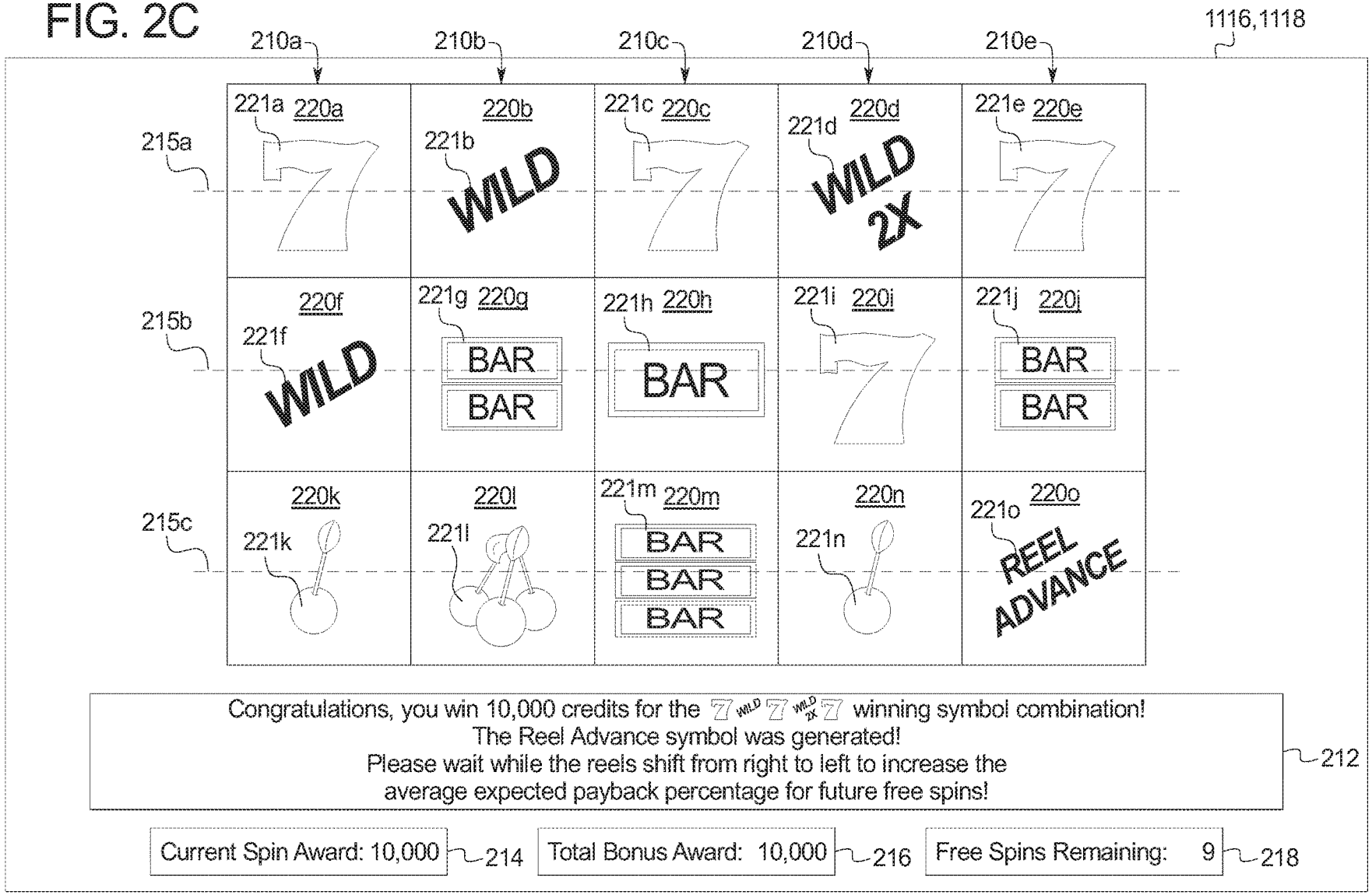

As illustrated in FIG. 2C, the gaming system generates and displays a plurality of the symbols on the reels at the symbol display areas. Specifically, in this illustrated example, the gaming system generates and displays: Seven symbol 221*a* at symbol display area 220*a*, Wild symbol 221*b* at symbol display area 220*b*, Seven symbol 221*c* at symbol display area 220*c*, Wild 2× symbol 221*d* at symbol display area 220*d*, Seven symbol 221*e* at symbol display area 220*e*, Wild symbol 221*f* at symbol display area 220*f*, Double Bar symbol 221*g* at symbol display area 220*g*, Bar symbol 221*h* at symbol display area 220*h*, Seven symbol 221*i* at symbol display area 220*i*, Double Bar symbol 221*j* at symbol display area 220*j*, Cherry symbol 221*k* at symbol display area 220*k*, Triple Cherry symbol 221*l* at symbol display area 220*l*, Triple Bar symbol 221*m* at symbol display area 220*m*, Cherry symbol 221*n* at symbol display area 220*n*, and Reel Advance symbol 221*o* at symbol display area 220*o*.

The gaming system makes an award determination based on the displayed symbols. More specifically, the gaming system determines whether the displayed symbols form any of a plurality of different winning symbol combinations along paylines 215*a*, 215*b*, and/or 215*c*. In this example, the gaming system determines an award of 10,000 credits associated with the Seven-Wild-Seven-Wild 2×-Seven winning symbol combination (which acts as a Seven-Seven-Seven-Seven-Seven winning symbol combination by virtue of the Wild symbols) displayed along payline 215*a*. The gaming system displays the total award of 10,000 credits for this free spin in Current Spin Award Meter 214 and updates the Total Bonus Award Meter 216 to reflect the 10,000 credit award. Additionally, because the Reel Advance symbol was generated and displayed on reel 210*e*, the gaming system determines that the reel modification event occurred and, therefore, modifies the first subset of the set of reels to create a second different subset of the set of reels to employ for at least the next free spin, as described below. The gaming system displays the following message in message display 212: "CONGRATULATIONS, YOU WIN 10,000 CREDITS FOR THE 7-WILD-7-WILD 2×-7 WINNING SYMBOL COMBINATION! THE REEL ADVANCE SYMBOL WAS GENERATED! PLEASE WAIT WHILE THE REELS SHIFT FROM RIGHT TO LEFT TO INCREASE THE AVERAGE EXPECTED PAYBACK PERCENTAGE FOR FUTURE FREE SPINS!"

Figure 2D:
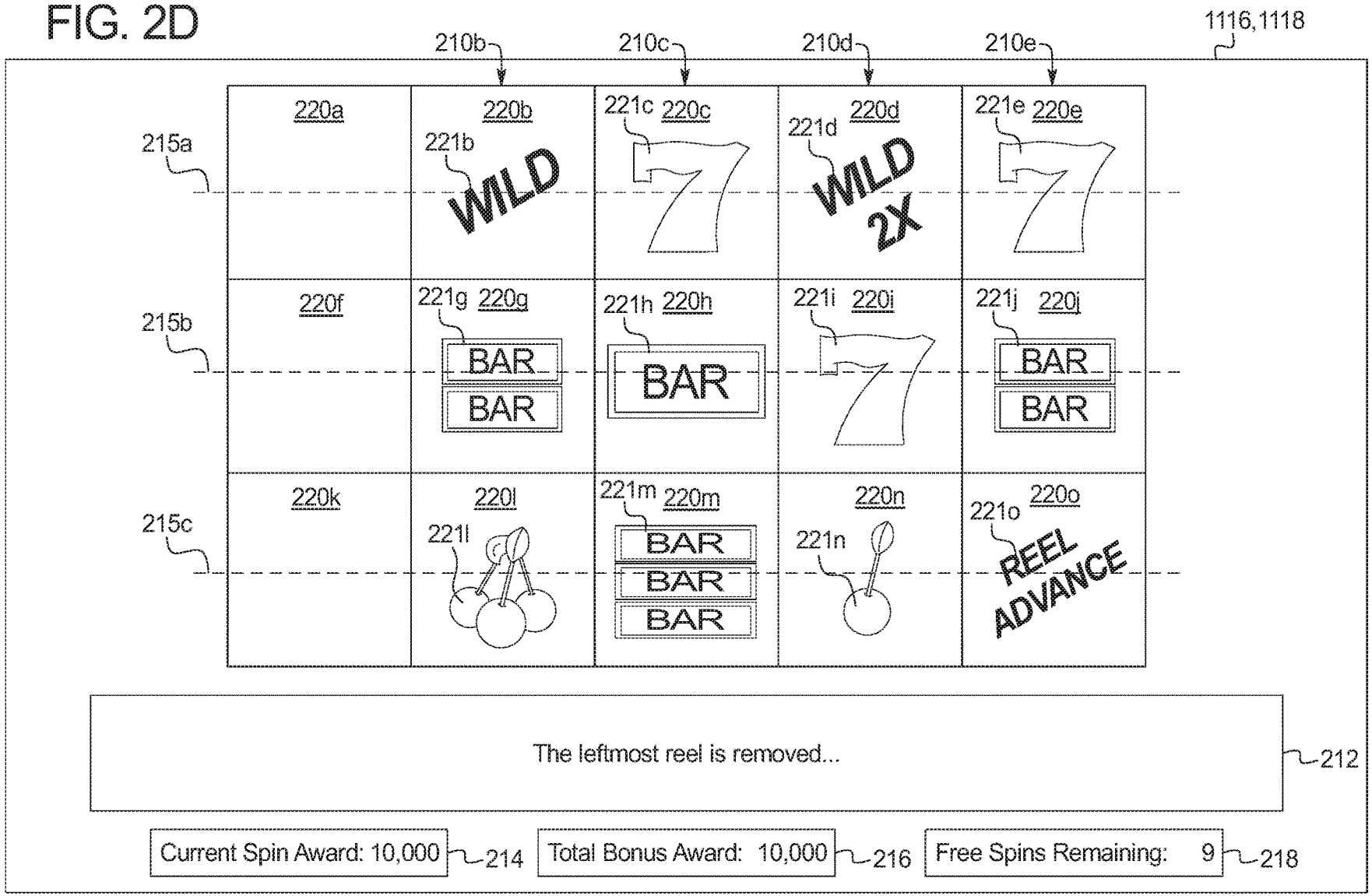

As illustrated in FIG. 2D, upon the occurrence of the reel modification event, the gaming system modifies the first subset of the set of reels by first removing leftmost reel 210*a*. The gaming system displays the following message in message display 212: "THE LEFTMOST REEL IS REMOVED . . . "

Figure 2E:
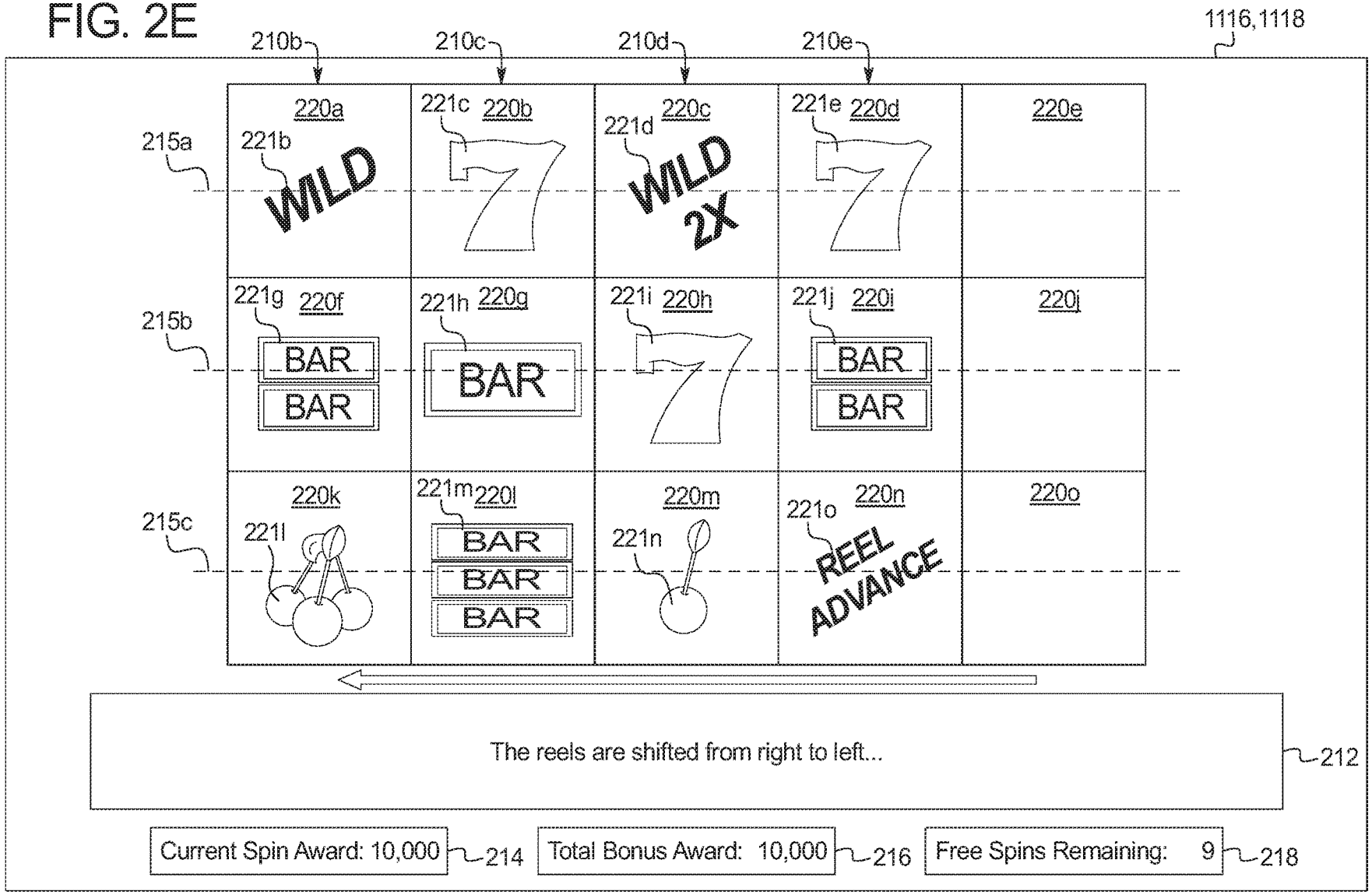

As illustrated in FIG. 2E, the gaming system continues to modify the first subset of the set of reels by shifting remaining reels 210*b*, 210*c*, 210*d*, and 210*e* from right to left such that: (a) reel 210*b* is displayed in association with symbol display areas 220*a*, 220*f*, and 220*k*; (b) reel 210*c* is displayed in association with symbol display areas 220*b*, 220*g*, and 220*l*; (c) reel 210*d* is displayed in association with symbol display areas 220*c*, 220*h*, and 220*m*; and (d) reel 210*e* is displayed in association with symbol display areas 220*d*, 220*i*, and 220*n*. The gaming system displays the following message in message display 212: "THE REELS ARE SHIFTED FROM RIGHT TO LEFT . . . "

Figure 2F:
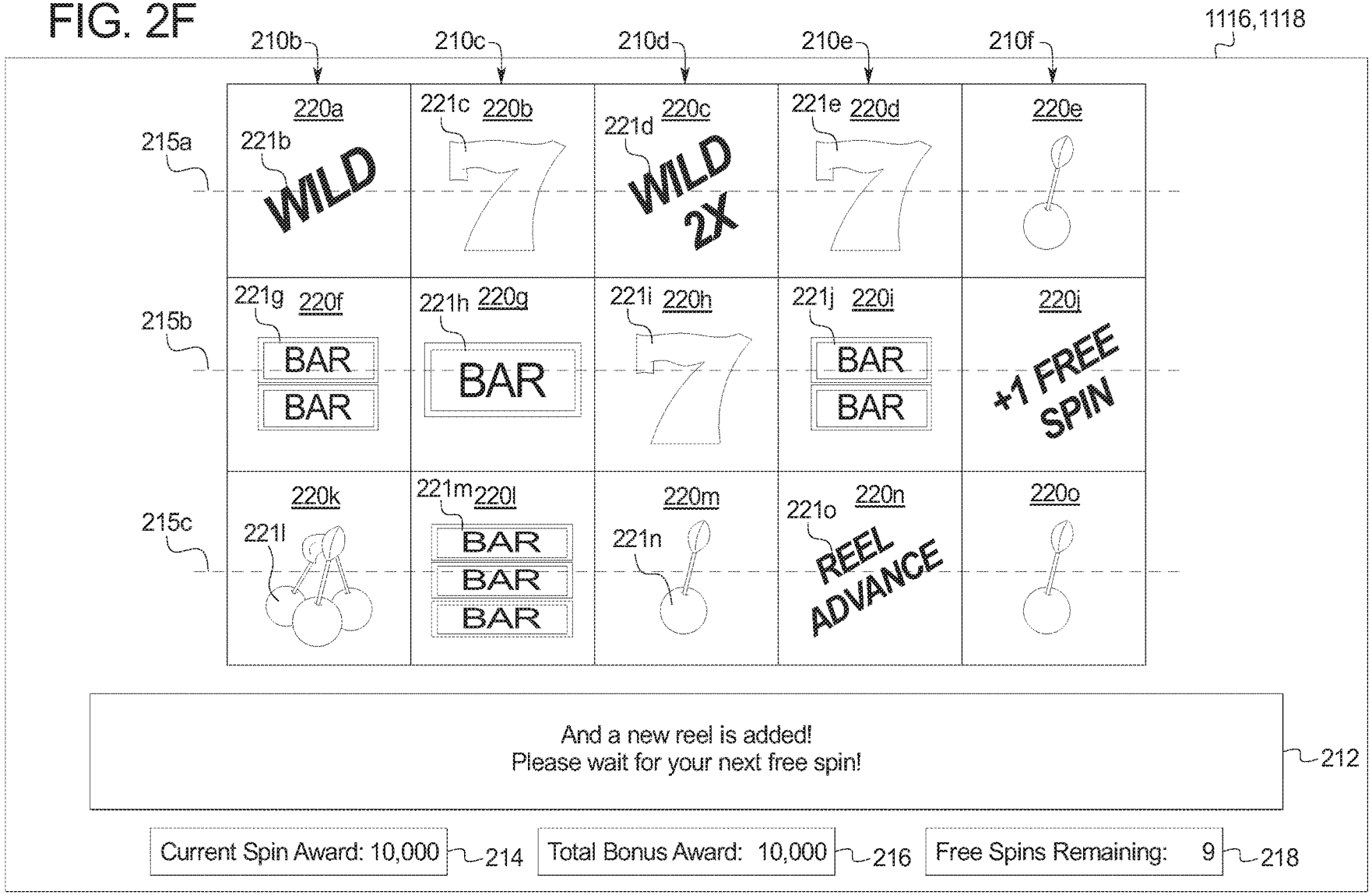

As illustrated in FIG. 2F, the gaming system completes the modification of the first subset of the set of reels by displaying new reel 210*f* in association with symbol display areas 220*e*, 220*j*, and 220*o* to create a second subset of the set of reels including reels 210*b*, 210*c*, 210*d*, 210*e*, and 210*f*. In this example, reel 210*f* includes at least one +1 Free Spin symbol that, if generated and displayed for one of the free spins, causes the gaming system to increase the player's remaining quantity of free spins by one. It should be appreciated that the removal of reel 210*a*, the shifting of reels 210*b*, 210*c*, 210*d*, and 210*e* from right to left, and the addition of reel 210*f* (i.e., the modification of the first subset of the reels to create the second subset of the set of reels) result in the average expected payback percentage of at least the subsequent free spin (which will employ the second subset of the set of reels) being greater than the average expected payback percentage of the previous free spin (which employed the first subset of the set of reels). In other words, in this example, once the symbol modification event occurs, the average expected payback percentage of the slot game increases for at least the next free spin. The gaming system displays the following message in message display 212: "AND A NEW REEL IS ADDED! PLEASE WAIT FOR YOUR NEXT FREE SPIN!"

Figure 2G:
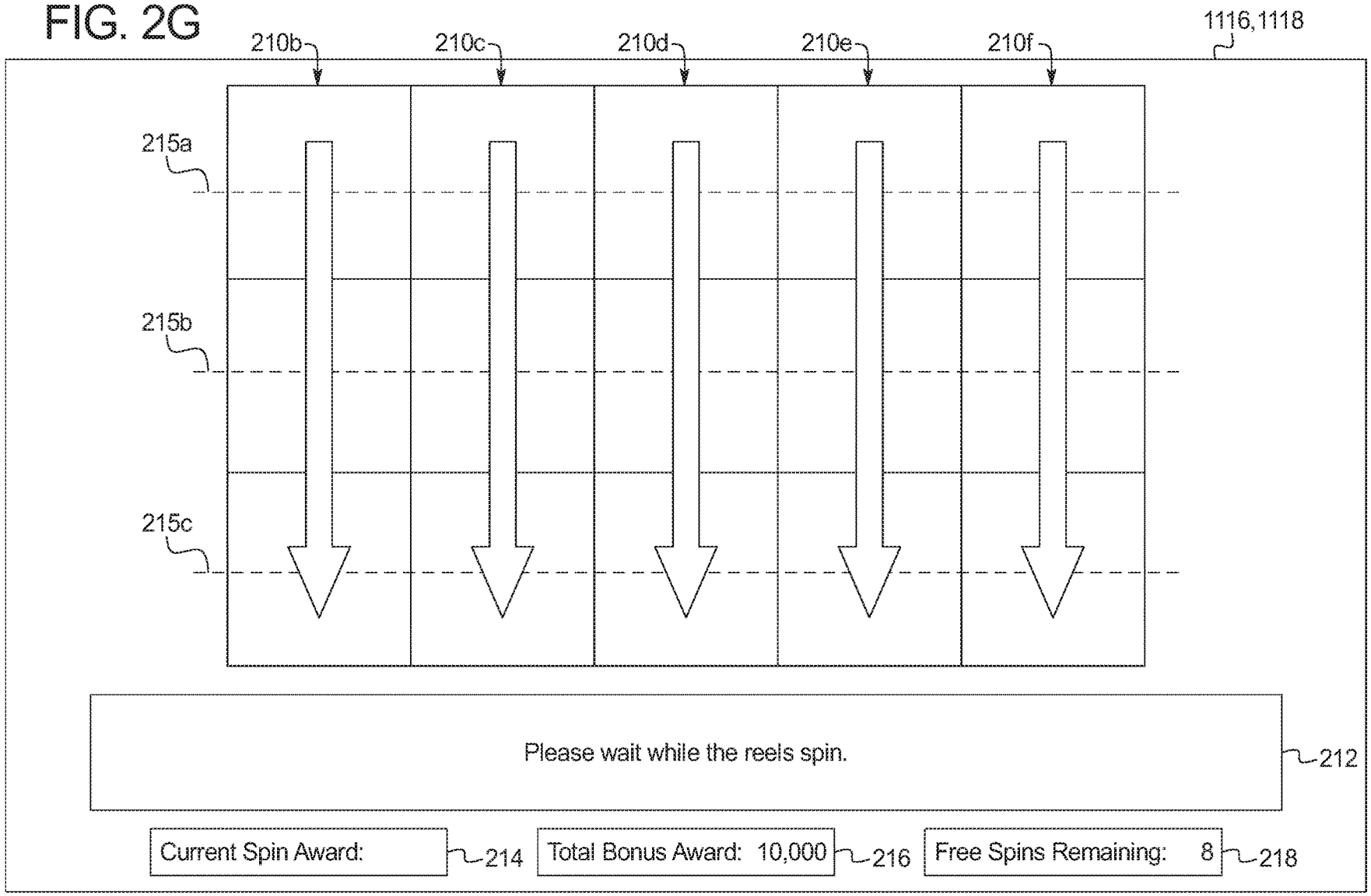

As illustrated in FIG. 2G, the gaming system initiates the second free spin employing the second subset of the set of reels including reels 210*b*, 210*c*, 210*d*, 210*e*, and 210*f*, and displays each of the reels spinning. The gaming system reduces the remaining quantity of free spins by one, and updates Free Spins Remaining Meter 218 accordingly. The gaming system displays the following message in message box 212: "PLEASE WAIT WHILE THE REELS SPIN."

Figure 2H:
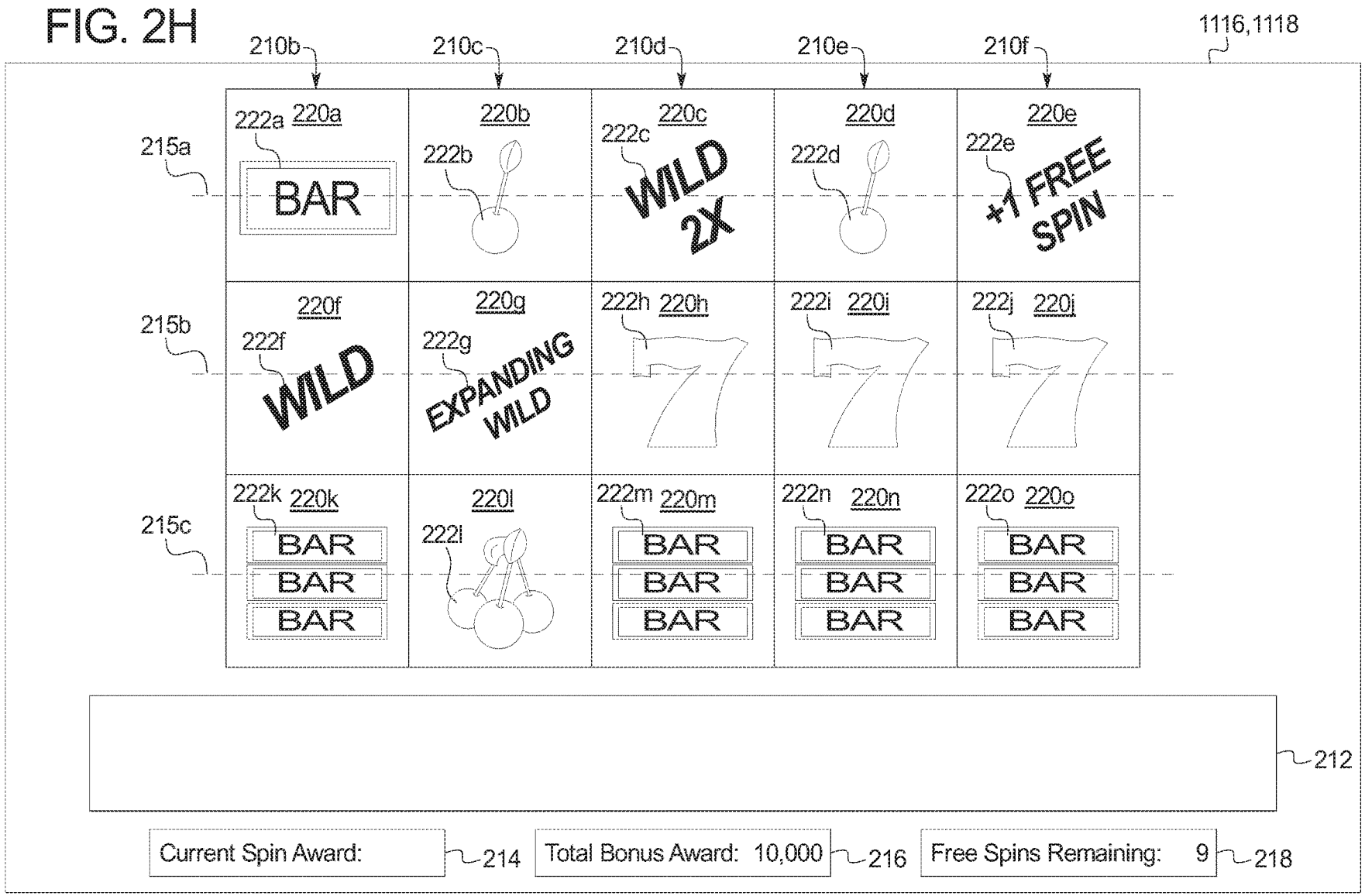

As illustrated in FIG. 2H, the gaming system generates and displays a plurality of the symbols on the reels at the symbol display areas. Specifically, in this illustrated example, the gaming system generates and displays: Bar symbol 222*a* at symbol display area 220*a*, Cherry symbol 222*b* at symbol display area 220*b*, Wild 2× symbol 222*c* at symbol display area 220*c*, Cherry symbol 222*d* at symbol display area 220*d*, +1 Free Spin symbol 222*e* at symbol display area 220*e*, Wild symbol 222*f* at symbol display area 220*f*, Expanding Wild symbol 222*g* at symbol display area 220*g*, Seven symbol 222*h* at symbol display area 220*h*, Seven symbol 222*i* at symbol display area 220*i*, Seven symbol 222*j* at symbol display area 220*j*, Triple Bar symbol 222*k* at symbol display area 220*k*, Triple Cherry symbol 222*l* at symbol display area 220*l*, Triple Bar symbol 222*m* at symbol display area 220*m*, Triple Bar symbol 222*n* at symbol display area 220*n*, and Triple Bar symbol 222*o* at symbol display area 220*o*.

Figure 2I:
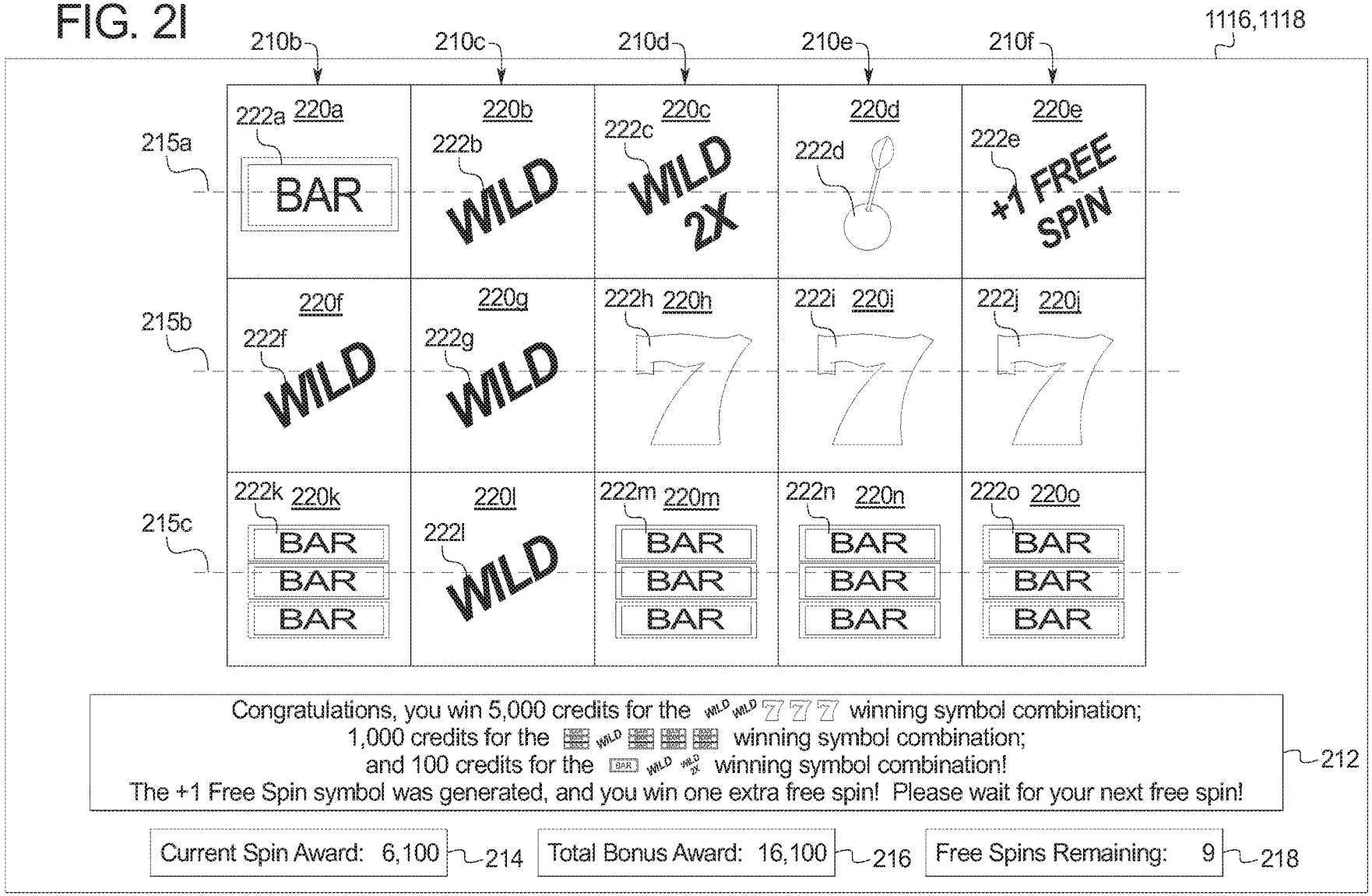

As illustrated in FIG. 2I, as a result of the generation and display of the Expanding Wild symbol 222*g*, the gaming system converts Cherry symbol 222*b* and Triple Cherry symbol 222*l* into Wild symbols 222*a* and 222*l*. The gaming system makes an award determination based on the displayed symbols. More specifically, the gaming system determines whether the displayed symbols form any of the winning symbol combinations along paylines 215*a*, 215*b*, and/or 215*c*. In this example, the gaming system determines an award of 5,000 credits associated with the Wild-Wild-Seven-Seven-Seven winning symbol combination (which acts as a Seven-Seven-Seven-Seven-Seven winning symbol combination by virtue of the Wild symbols) displayed along payline 215*b*; an award of 1,000 credits associated with the Triple Bar-Wild-Triple Bar-Triple Bar-Triple Bar winning symbol combination (which acts as a Triple Bar-Triple Bar-Triple Bar-Triple Bar-Triple Bar winning symbol combination by virtue of the Wild symbol) displayed along payline 215*c*; and an award of 100 credits for the Bar-Wild-Wild 2× winning symbol combination (which acts as a Bar-Bar-Bar winning symbol combination by virtue of the Wild symbols) displayed along payline 215*a*.

The gaming system displays the total award of 6,100 credits for this free spin in Current Spin Award Meter 214 and updates the Total Bonus Award Meter 216 to reflect the 6,100 credit award. Additionally, because the +1 Free Spin symbol was generated and displayed on reel 210*f*, the gaming system increases the player's remaining quantity of free spins by one and updates Free Spins Remaining Meter 218 accordingly. The gaming system displays the following message in message display 212: "CONGRATULATIONS, YOU WIN 5,000 CREDITS FOR THE WILD-WILD-7-7-7 WINNING SYMBOL COMBINATION; 1,000 CREDITS FOR THE TRIPLE BAR-WILD-TRIPLE BAR-TRIPLE BAR-TRIPLE BAR WINNING SYMBOL COMBINATION, AND 100 CREDITS FOR THE BAR-WILD-WILD 2× WINNING SYMBOL COMBINATION! THE +1 FREE SPIN SYMBOL WAS GENERATED, AND YOU WIN ONE EXTRA FREE SPIN! PLEASE WAIT FOR YOUR NEXT FREE SPIN!"

Figure 2J:
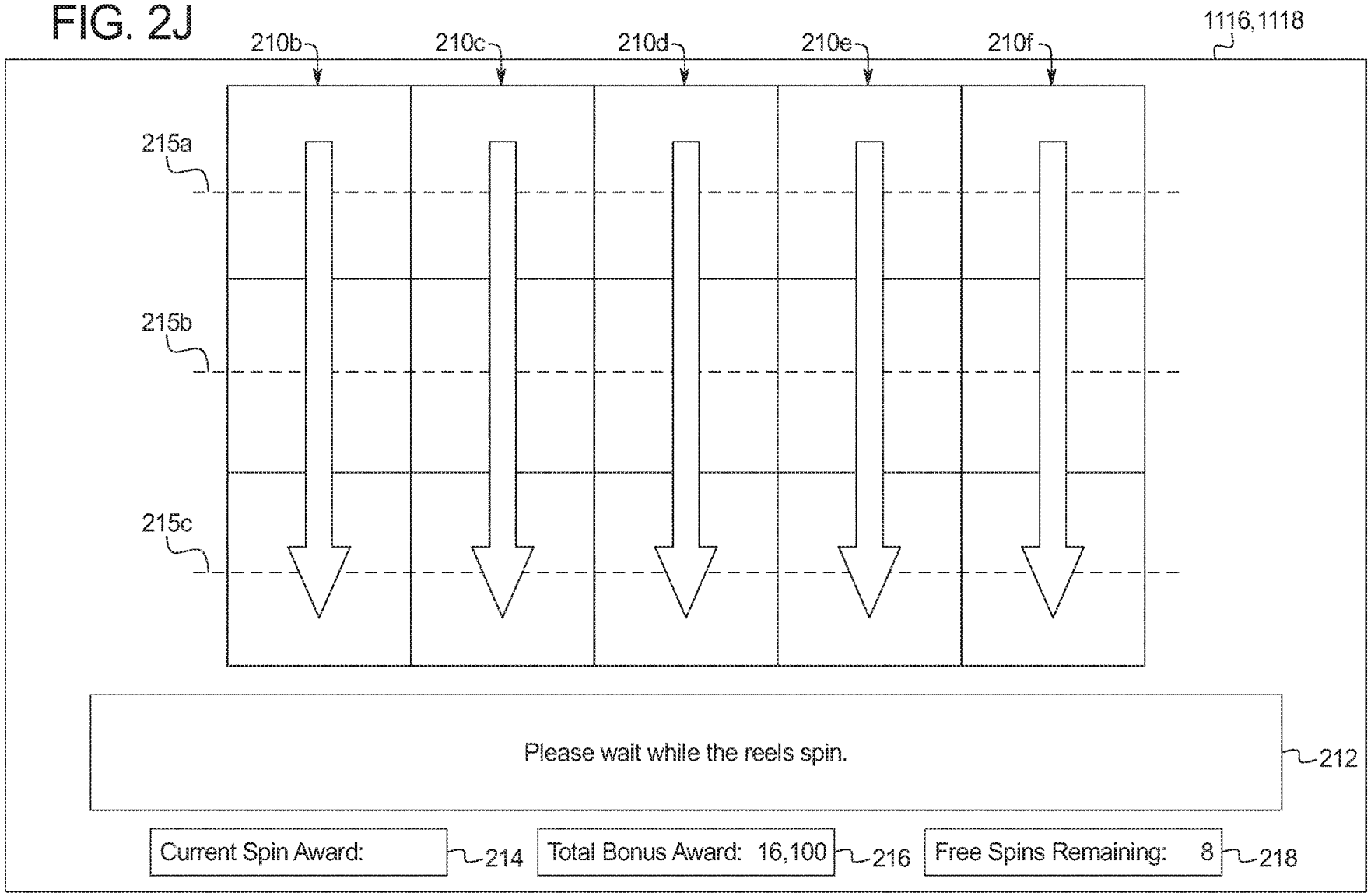

Since the reel modification event did not occur in association with the second free spin, the gaming system employs the second subset of the set of reels including reels 210*b*, 210*c*, 210*d*, 210*e*, and 210*f* for the third free spin. As illustrated in FIG. 2J, the gaming system initiates the third free spin and displays each of the reels spinning. The gaming system reduces the remaining quantity of free spins by one, and updates Free Spins Remaining Meter 218 accordingly. The gaming system displays the following message in message box 212: "PLEASE WAIT WHILE THE REELS SPIN."

Figure 2K:
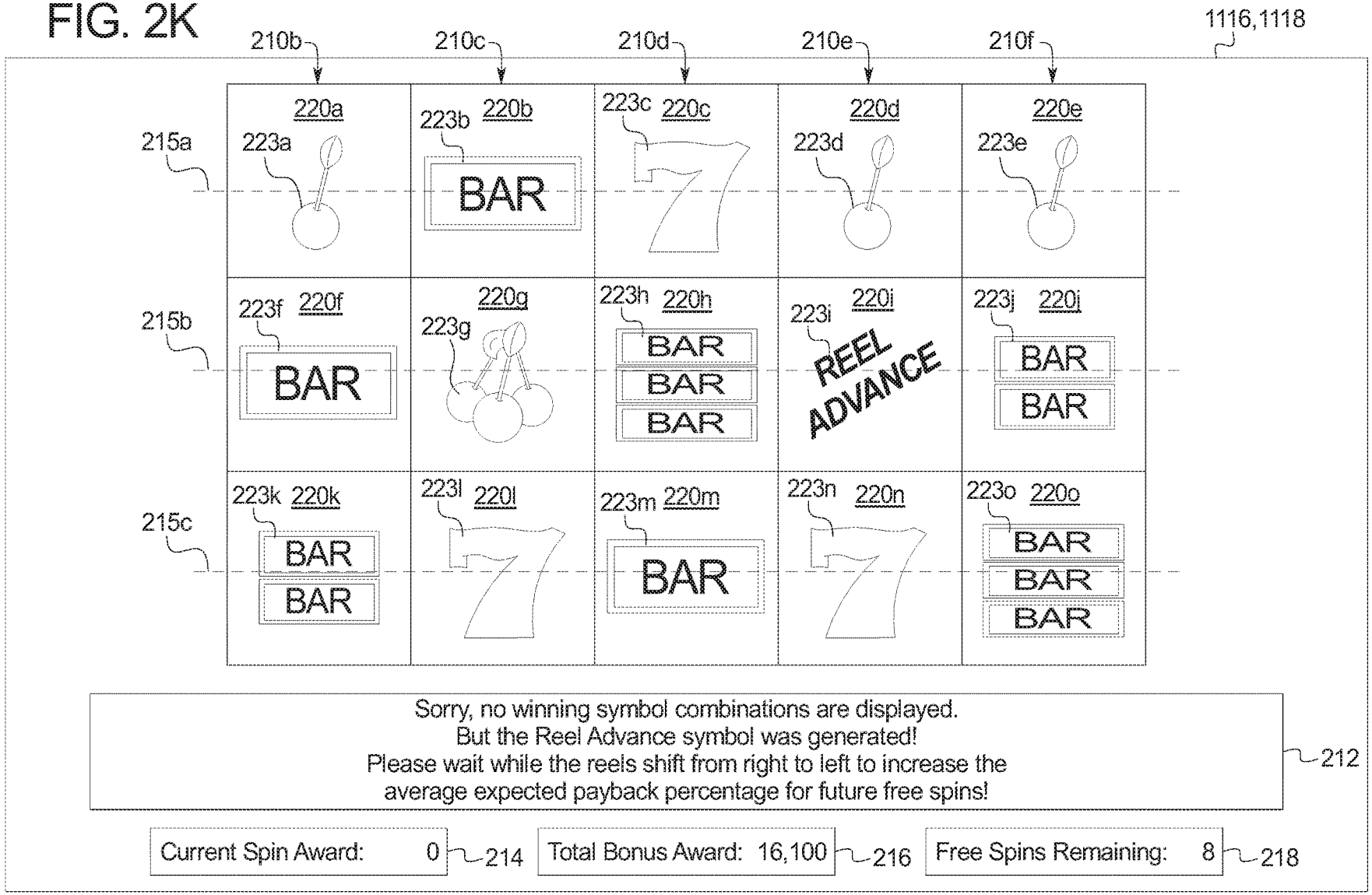

As illustrated in FIG. 2K, the gaming system generates and displays a plurality of the symbols on the reels at the symbol display areas. Specifically, in this illustrated example, the gaming system generates and displays: Cherry symbol 223*a* at symbol display area 220*a*, Bar symbol 223*b* at symbol display area 220*b*, Seven symbol 223*c* at symbol display area 220*c*, Cherry symbol 223*d* at symbol display area 220*d*, Cherry symbol 223*e* at symbol display area 220*e*, Bar symbol 223*f* at symbol display area 220*f*, Triple Cherry symbol 223*g* at symbol display area 220*g*, Triple Bar symbol 223*h* at symbol display area 220*h*, Reel Advance symbol 223*i* at symbol display area 220*i*, Double Bar symbol 223*j* at symbol display area 220*j*, Double Bar symbol 223*k* at symbol display area 220*k*, Seven symbol 223*l* at symbol display area 220*l*, Bar symbol 223*m* at symbol display area 220*m*, Seven symbol 223*n* at symbol display area 220*n*, and Triple Bar symbol 223*o* at symbol display area 220*o*.

The gaming system makes an award determination based on the displayed symbols. More specifically, the gaming system determines whether the displayed symbols form any of the winning symbol combinations along paylines 215*a*, 215*b*, and/or 215*c*. In this example, none of the displayed symbols form any of the winning symbol combinations. However, because the Reel Advance symbol was generated and displayed on reel 210*e*, the gaming system determines that the reel modification event occurred and, therefore, modifies the second subset of the set of reels to create a third different subset of the set of reels to employ for at least the next free spin, as described below. The gaming system displays the following message in message display 212: "SORRY, NO WINNING SYMBOL COMBINATIONS ARE DISPLAYED. BUT THE REEL ADVANCE SYMBOL WAS GENERATED! PLEASE WAIT WHILE THE REELS SHIFT FROM RIGHT TO LEFT TO INCREASE THE AVERAGE EXPECTED PAYBACK PERCENTAGE FOR FUTURE FREE SPINS!"

Figure 2L:
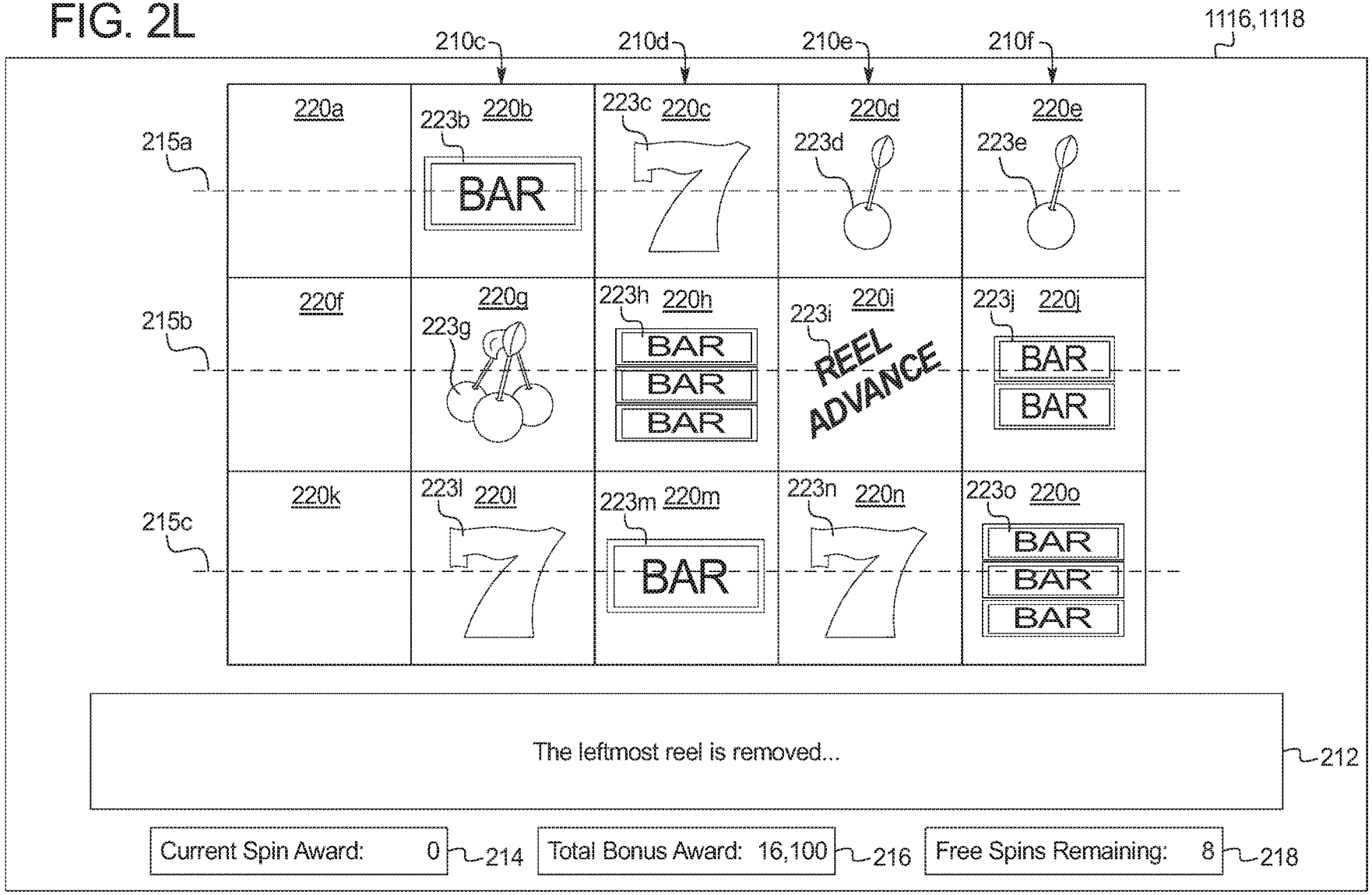

As illustrated in FIG. 2L, upon the occurrence of the reel modification event, the gaming system modifies the second subset of the set of reels by first removing leftmost reel 210*b*. The gaming system displays the following message in message display 212: "THE LEFTMOST REEL IS REMOVED . . . "

Figure 2M:
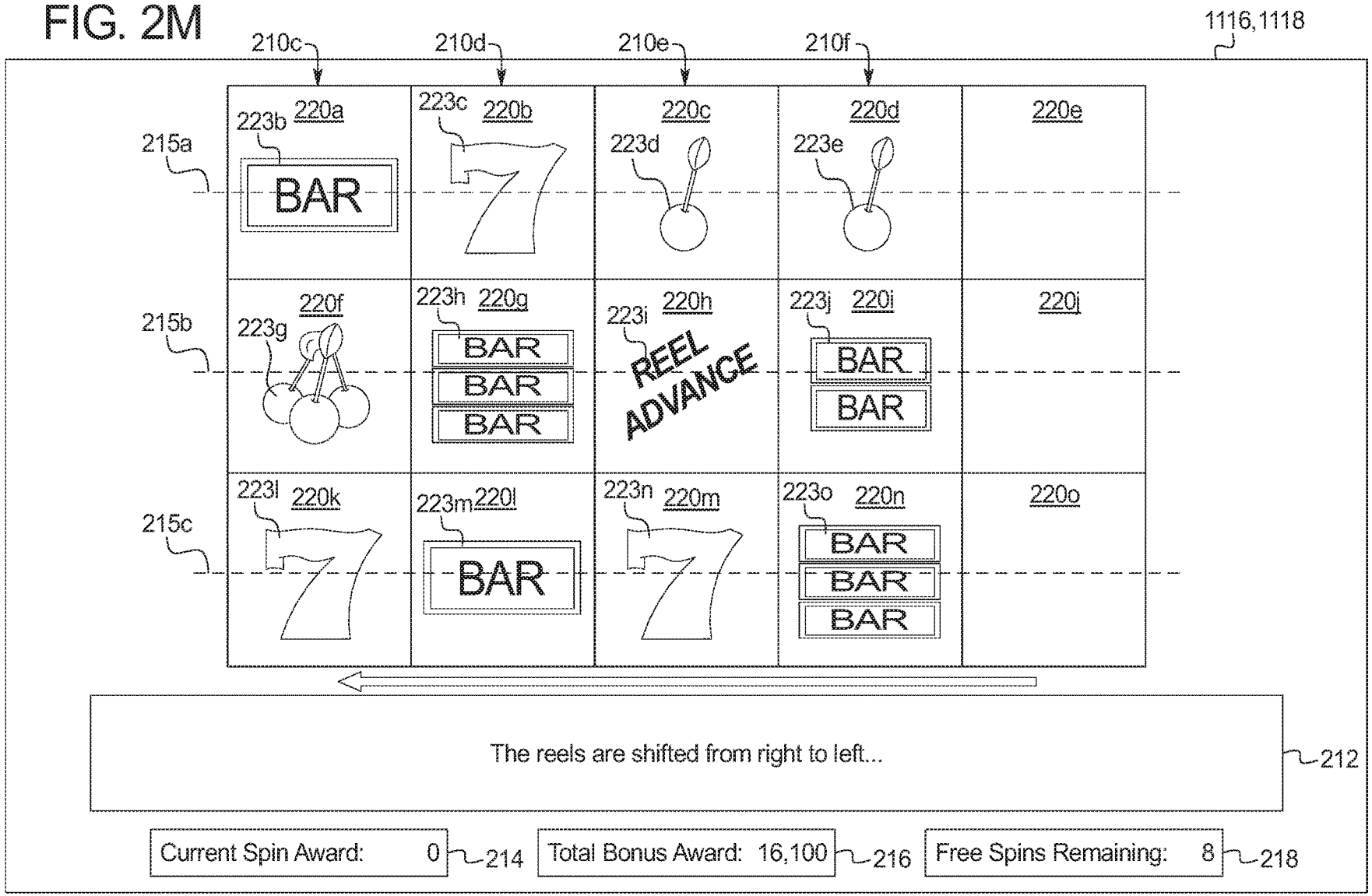

As illustrated in FIG. 2M, the gaming system continues to modify the second subset of the set of reels by shifting remaining reels 210*c*, 210*d*, 210*e*, and 210*f* from right to left such that: (a) reel 210*c* is displayed in association with symbol display areas 220*a*, 220*f*, and 220*k*; (b) reel 210*d* is displayed in association with symbol display areas 220*b*, 220*g*, and 220*l*; (c) reel 210*e* is displayed in association with symbol display areas 220*c*, 220*h*, and 220*m*; and (d) reel 210*f* is displayed in association with symbol display areas 220*d*, 220*i*, and 220*n*. The gaming system displays the following message in message display 212: "THE REELS ARE SHIFTED FROM RIGHT TO LEFT . . . "

Figure 2N:
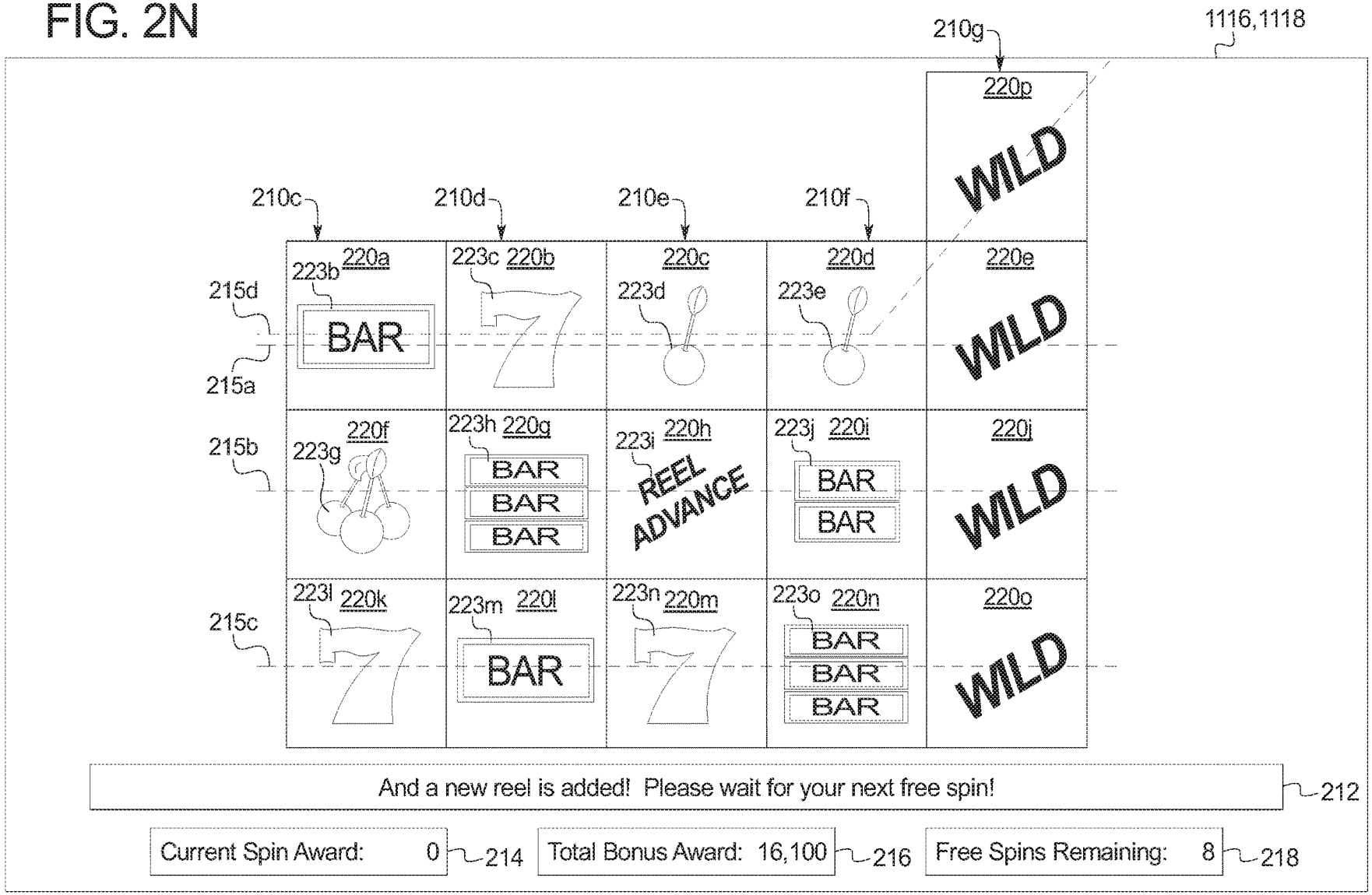

As illustrated in FIG. 2N, the gaming system completes the modification of the second subset of the set of reels by displaying new reel 210*g* in association with symbol display areas 220*e*, 220*j*, 220*o*, and new symbol display area 220*p* to create a third subset of the set of reels including reels 210*c*, 210*d*, 210*e*, 210*f*, and 210*g*. It should be appreciated that reel 210*g* is larger than each of reels 210*c*, 210*d*, 210*e*, and 210*f*. The gaming system displays an additional payline 215*d* that is associated with symbol display areas 220*a*, 220*b*, 220*c*, 220*d*, and 220*p*. In this example, reel 210*g* includes all wild symbols. It should be appreciated that the removal of reel 210*b*, the shifting of reels 210*c*, 210*d*, 210*e*, and 210*f* from right to left, and the addition of reel 210*g* (i.e., the modification of the second subset of the reels to create the third subset of the set of reels) result in the average expected payback percentage of at least the subsequent free spin (which will employ the third subset of the set of reels) being greater than the average expected payback percentage of the previous free spin (which employed the second subset of the set of reels). In other words, in this example, once the symbol modification event occurs, the average expected payback percentage of the slot game increases for at least the next free spin. The gaming system displays the following message in message display 212: "AND A NEW REEL IS ADDED! PLEASE WAIT FOR YOUR NEXT FREE SPIN!"

It should be appreciated that the reels may be associated with any suitable feature or features. For example, in various embodiments, at least one of the reels: (a) includes a higher concentration of high value symbols (such as major symbols, Wild symbols, and/or Bonus symbols) than low value symbols; (b) includes only high value symbols; (c) includes at least one multiplier Wild symbol (such as the 2× Wild symbol described above); (d) includes at least one modifier (such as a multiplier); (e) includes a stack of a plurality of instances of a Wild symbol arranged adjacent to one another; (f) includes a stack of a plurality of instances of a multiplier Wild symbol arranged adjacent to one another; (g) includes at least one free play retrigger symbol that, if generated and displayed for a play of the slot game, causes the gaming system to provide at least one free play of the slot game or to retrigger the free play bonus; (h) includes one or more trigger symbols (such as the Reel Advance symbol described above) that, when generated and displayed for a play of the slot game, cause the symbol modification event to occur; (i) includes one or more split symbols (such as double symbols, triple symbols, or quadruple symbols); (j) is associated with more symbol display areas that at least one of the other reels (e.g., is taller or wider than at least one of the other reels); (k) is associated with a single one of the symbol display areas (e.g., is a unisymbol reel); (L) includes a stack of a plurality of instances of a symbol arranged adjacent to one another; (m) includes one or more bonus trigger symbols that, if generated and displayed for a play of the slot game, cause the gaming system to provide one or more bonus features (such as bonus games); (n) includes one or more accumulative symbols that the player may accumulate and subsequently redeem to convert certain symbols (such as low value symbols) into designated symbols (such as Wild symbols); (o) includes one or more scatter symbols that, if generated and displayed for a play of the slot game, cause the gaming system to provide a scatter award; (p) includes one or more symbols not associated with at least one of the reels and that are included in one or more new winning symbol combinations; (q) includes one or more symbols that, if generated and displayed during a play of the slot game, cause the gaming system to re-spin one or more of the reels; (r) includes a horizontal large symbol feature in which one or more symbols spans at least two adjacent reels (and thus spans and is configured to be displayed at at least two horizontally adjacent symbol display areas); (s) includes a vertical large symbol feature in which one or more symbols on that reel spans and is configured to be displayed at at least two vertically adjacent symbol display areas; (t) includes a vertical or a horizontal tumbling reels feature; (u) includes a locked wilds feature in which at least one Wild symbol is guaranteed to be generated and displayed at a specific symbol display areas associated with that reel following the spin; (v) includes a changing symbol stack feature in which the symbols that are stacked change as the reels shift and/or spin; (w) includes a wild reel feature that causes the reel to, when stopped, display all Wild symbols a certain percentage of the time, wherein the percentage is less than 100%; (x) includes a symbol that triggers a progressive jackpot if that symbol is generated and displayed on one of the reels and, in certain embodiments, is part of a displayed winning symbol combination; (y) modifies the quantity of available winning outcomes (for example: (a) the free spin game can start as a 3×5 slot game and progress to a 4×5 slot game as 3×1 reels are removed and 4×1 reels are added; or (b) the free spin game could progress as follows (each number represents a reel and how many symbol display positions are associated with that reel): 33333=>33334=>33345=>33456=>34567); and/or (z) includes a random height that is at least a minimum height and at most a maximum height (i.e., is associated with a randomly determined quantity of symbol display areas between a minimum quantity and a maximum quantity).

It should be appreciated that any suitable number of the reels may be associated with at least one feature. For instance, one embodiment, only one of the reels is associated with at least one feature. In another embodiment, a plurality of, but less than all of, the reels are each associated with at least one feature. In another embodiment, at least one of the reels is not associated with any feature. In another embodiment, at least one of the reels is associated with a plurality of different features.

In various embodiments, upon the occurrence of the reel modification event, the gaming system: (a) provides at least one additional free play of the slot game; (b) removes a designated quantity of the reels and adds the same designated quantity of the reels from the set (e.g., removes one reel and adds one reel, removes two reels and adds two reels, removes three reels and adds three reels, removes four reels and adds four reels, or removes five reels and adds five reels); (c) removes a randomly determined quantity of the reels and adds that same randomly determined quantity of the reels from the set; (d) removes a quantity of the reels determined based on the quantity of displayed trigger symbols and adds that same determined quantity of the reels from the set (e.g., the gaming system removes and adds two reels when two trigger symbols are generated and displayed for a play of the slot game, and removes and adds one reel when one trigger symbol is generated and displayed for a play of the slot game); (e) removes and adds different quantities of the reels (e.g., removes one reel and adds two reels); (f) replaces the current subset of the reels with another different predetermined subset of the reels; (g) updates certain background elements to signify the removal of and the addition of reels (for example, displays a character walking further into a cave and changing the background from displaying a drab cave to displaying a cavern full of crystals); (h) adds at least one of the reels from the set without removing any of the reels (e.g., a 3×5 slot game becomes a 3×6 reel slot game after the occurrence of the reel modification event); (i) removes one of the reels and adds another one of the reels that is identical to one of the reels to which it is adjacent (in one example, the two identical adjacent reels spin in sync with one another, thereby increasing the likelihood of winning symbol combinations being generated); (j) replaces one of the reels with another one of the reels from the set (i.e., removes one of the reels and adds another one of the reels in the same position from which the removed reel was removed, without shifting any of the other reels); and/or (k) removes a previously-added reel and adds a previously-removed reel.

It should be appreciated that the reel modification event may be any suitable event. In one embodiment, the reel modification event occurs when a designated quantity of at least one trigger symbol is generated and displayed for a play of the slot game. In another embodiment, the reel modification event occurs when the player collects a designated quantity of at least two trigger symbols in the same play of the slot game or over a plurality of different plays of the slot game. In another embodiment, the reel modification event occurs when a play of the slot game is completed. In other words, in this embodiment, the gaming system removes and adds at least one reel after each play of the slot game. In another embodiment, the gaming system enables the player to choose the reel modification event. For instance, upon initiation of the free play bonus, the gaming system enables the player to select one of a plurality of different events, and employs the selected event as the reel modification event. In another embodiment, the reel modification event is a mystery event that occurs randomly at the start of a play of the game. In another embodiment, the reel modification event occurs when one of at least one designated outcome (such as a designated winning outcome) is generated and displayed for a play of the slot game. It should be appreciated that the gaming system may employ any suitable combination of a plurality of different reel modification events, at least two of which may have different results (e.g., when a first reel modification event occurs, the gaming system removes a single reel and adds a single reel, and when a second different reel modification event occurs, the gaming system removes two reels and adds two reels).

In certain embodiments in which the reel modification event occurs when at least one trigger symbol is generated and displayed for a play of the slot game, at least one instance of the trigger symbol may be included on: (a) each of the plurality of reels; (b) at least one of, but fewer than all of, the plurality of reels; (c) a plurality of, but fewer than all of, the plurality of reels; (d) only a designated quantity of the plurality of reels; (e) every fifth reel; (f) every third reel; (g) every other reel; and/or (h) one or more reel overlays such that, because the trigger symbols are not tied to the reels (which are being removed, added, and/or shifted during game play), the generation of such trigger symbols remains constant.

In one embodiment, instead of or in addition to removing and adding one or more reels to increase the average expected payback percentage of at least one subsequent play of the slot game, the gaming system replaces one or more reels to increase the average expected payback percentage of at least one subsequent play of the slot game. For instance, when the reel modification event occurs, the gaming system replaces at least one of the reels with another one of the reels of the set such that the average expected payback percentage increases for at least one subsequent play of the slot game. In one example, when the reel modification event occurs, the gaming system replaces a reel including one Wild symbol with a reel including a stack of five Wild symbols.

In another embodiment, instead of or in addition to removing and adding one or more reels to increase the average expected payback percentage of at least one subsequent play of the slot game, the gaming system switches the position of two or more of the reels to increase the average expected payback percentage of at least one subsequent play of the slot game. For instance, when the reel modification event occurs, the gaming system switches the positions of Reel 5, which is a reel including all Wild symbols, and Reel 1, which includes a single Wild symbol, thereby increasing the average expected payback percentage for at least one subsequent play of the slot game.

In another embodiment, instead of or in addition to removing and adding one or more reels to increase the average expected payback percentage of at least one subsequent play of the slot game, the gaming system adds an additional reel from the set to create a subset of the reels including more reels than the previously employed subset of the reels to increase the average expected payback percentage of at least one subsequent play of the slot game. For instance, when the reel modification event occurs, the gaming system adds a sixth reel without removing any of the five displayed reels.

In another embodiment, instead of or in addition to removing and adding one or more reels to increase the average expected payback percentage of at least one subsequent play of the slot game, the gaming system adds one or more features or characteristics to at least one of the reels to increase the average expected payback percentage of at least one subsequent play of the slot game. For instance, when the reel modification event occurs, the gaming system adds a 2× multiplier symbol to one of the reels, thereby increasing the average expected payback percentage for at least one subsequent play of the slot game.

It should be appreciated that:

(a) the quantity of reels associated with the slot game (e.g., the quantity of reels in the set of reels);

(b) the order of the reels;

(c) the quantity of symbol display areas;

(d) the quantity of symbol display areas with which each reel is associated;

(e) the quantity of paylines;

(f) the quantity of symbol display areas with which each payline is associated;

(g) the specific symbol display areas with which each reel is associated;

(h) the specific symbol display areas with which each payline is associated;

(i) the quantity of winning symbol combinations;

(j) the award associated with each winning symbol combination;

(k) the specific winning symbol combinations;

(l) the number of reels removed upon the occurrence of the reel modification event;

(m) the number of reels shifted upon the occurrence of the reel modification event;

(n) the number of reels added upon the occurrence of the reel modification event;

(o) which reels are removed upon the occurrence of the reel modification event;

(p) which reels are shifted upon the occurrence of the reel modification event;

(q) which reels are added upon the occurrence of the reel modification event;

(r) the number of reels to replace (if any) upon the occurrence of the reel modification event;

(s) which reels (if any) are replaced upon the occurrence of the reel modification event;

(t) the time or quantity of plays for which the modified subset is employed;

(u) the number of reels associated with features;

(v) the specific features that are associated with the individual reels;

(w) the available feature(s) with which one or more reels may be associated;

(x) the reels of the initial subset of the reels;

(y) the quantity of reels the gaming system employs for the play of the slot game;

(z) the occurrence reel modification event;

(aa) the quantity of triggering symbols that must be collected (if any) to trigger the reel modification event;

(bb) the increase in the average expected payback percentage upon the occurrence of the reel modification event;

(cc) the quantity of free plays in the free play bonus;

(dd) the symbols used;

(ee) the quantity of reels in each predetermined subset of the reels (if any);

(ff) the probability of occurrence of each reel modification event;

(gg) the direction in which the reels are shifted; and/or (hh) any other variable or determination described herein may be: (1) predetermined; (2) randomly determined; (3) randomly determined based on one or more weighted percentages; (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an electronic gaming machine (EGM) configured to operate a primary game or a bonus game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager; (17) determined independent of the player's primary game wager; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
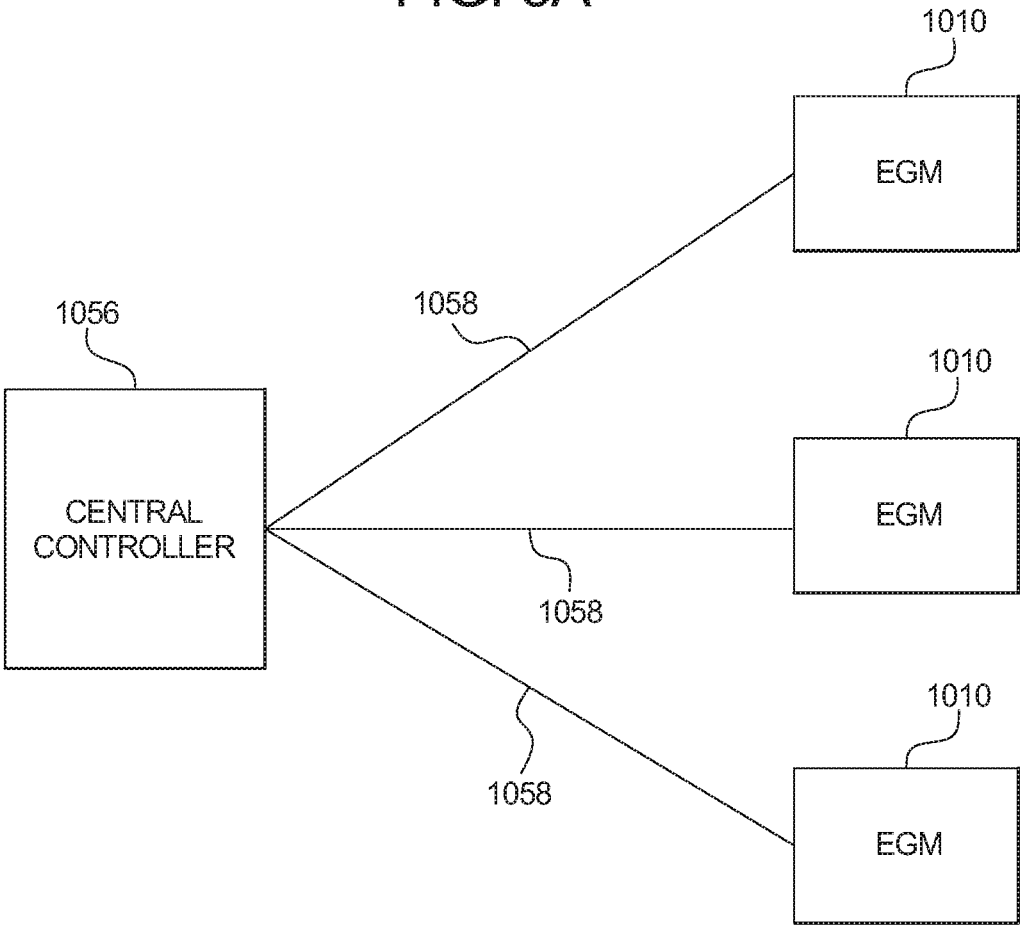
FIG. 3A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
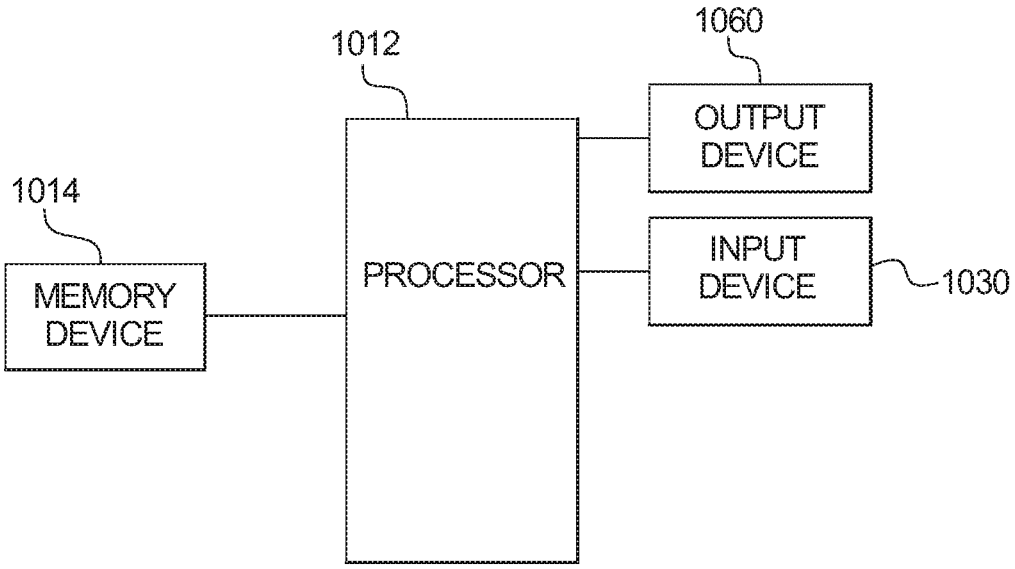
FIG. 3B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
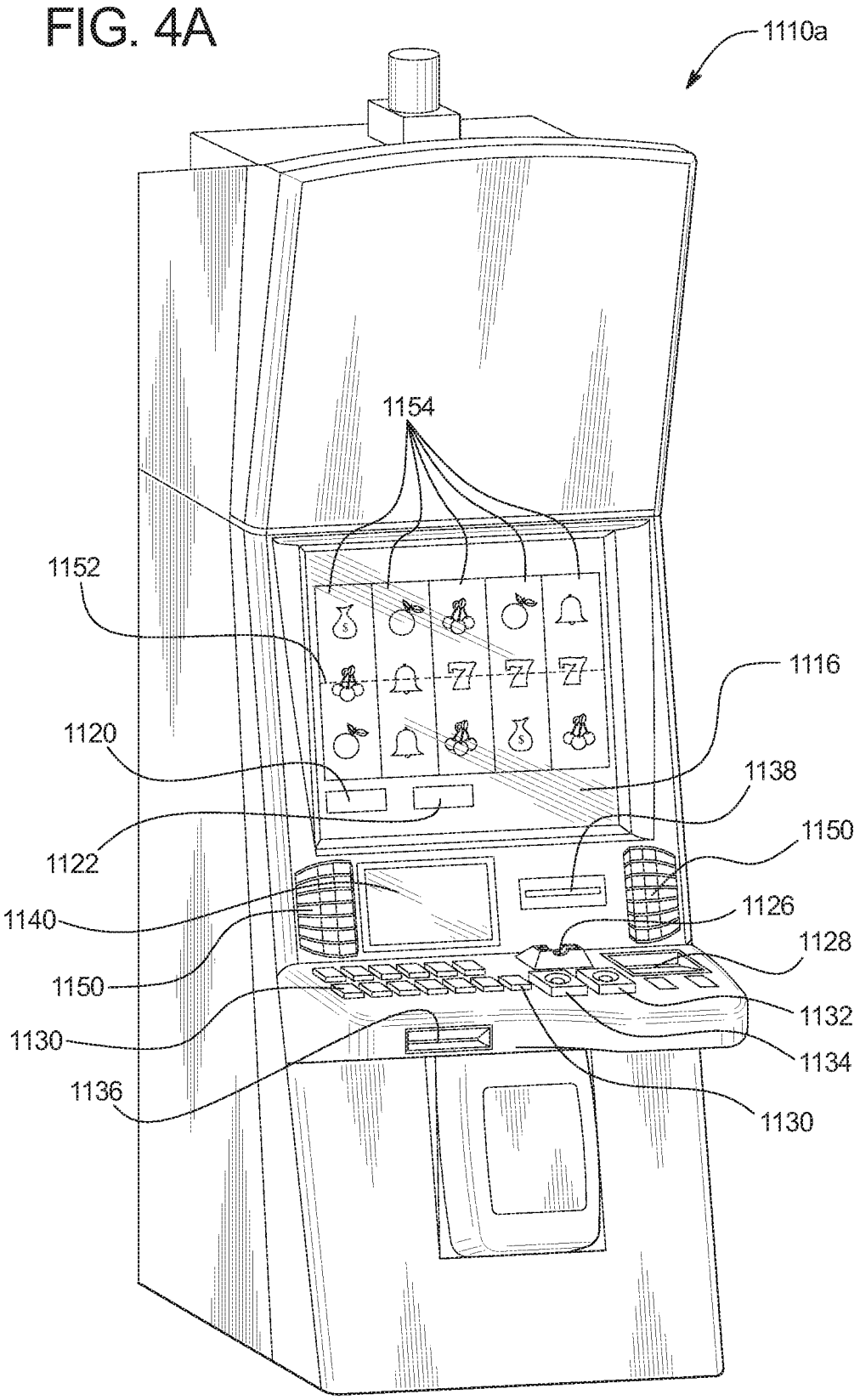
FIGS. 4A and 4B are perspective views of example alternative embodiments of the gaming system of the present disclosure.
Figure 4B:
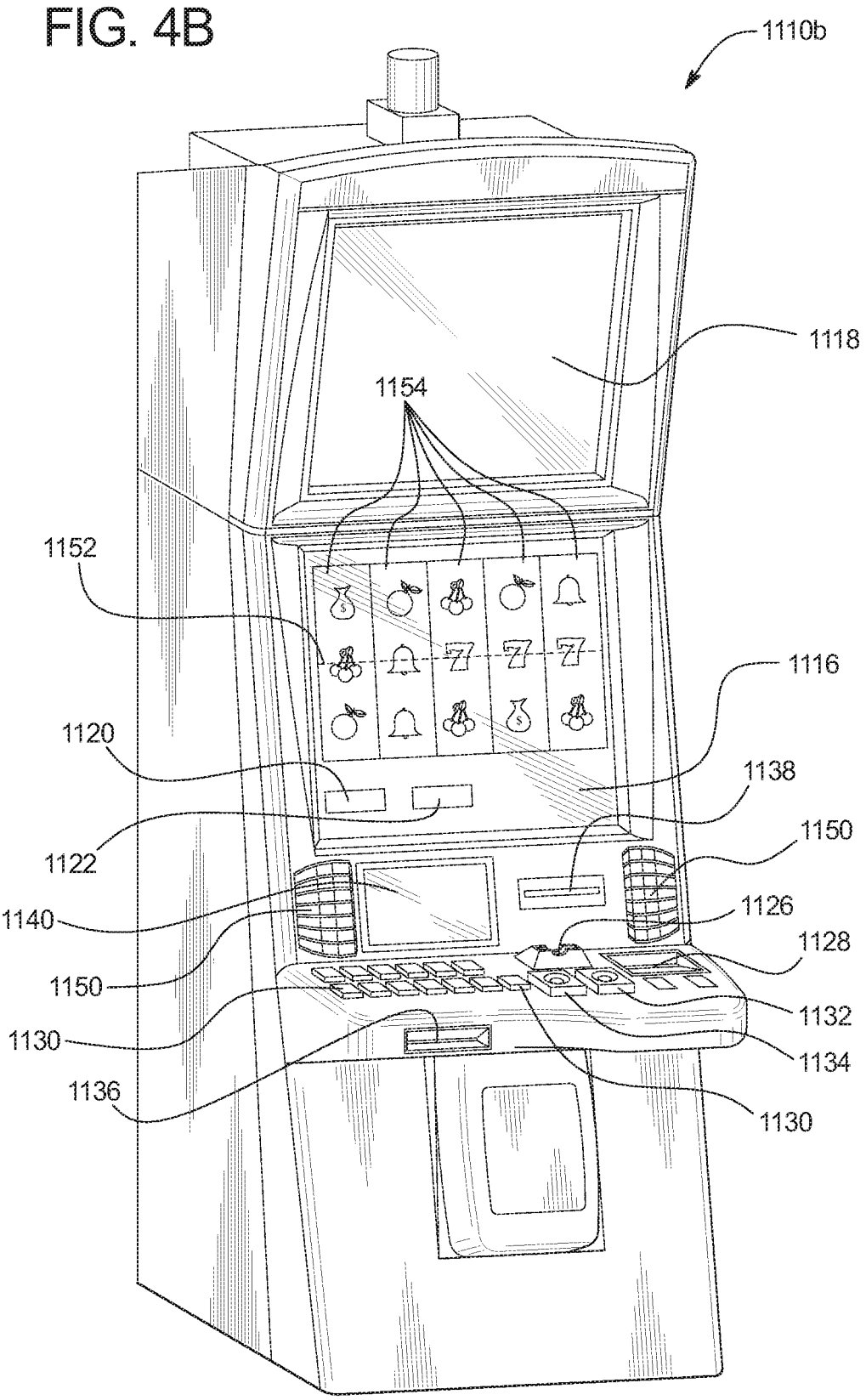

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 4A and 4B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of operating an electronic gaming machine, the method comprising:

responsive to receipt, by a payment acceptor, of a payment input including a physical item, establishing, by a processor, a credit balance based on a monetary value associated with the payment input;

for a first symbol generator activation, wherein the first symbol generator activation has a first average expected payback percentage and is associated with a plurality of symbol generators comprising a plurality of symbols:

randomly determining, by the processor, a first plurality of the plurality of symbols;

causing, by the processor, a display of the first plurality of the plurality of symbols by a display device;

determining, by the processor and in accordance with a first paytable, any award amounts for the first symbol generator activation based on the first plurality of the plurality of symbols; and causing, by the processor, a display of any award amounts for the first symbol generator activation by the display device, wherein the credit balance is increasable based on any award amounts for the first symbol generator activation;

responsive to less than a designated quantity of modification symbols being collected prior to the first symbol generator activation and the first plurality of the plurality of symbols including, independent of any determined award amounts for the first symbol generator activation, a modification symbol that when combined with any modification symbols collected prior to the first symbol generator activation results in at least the designated quantity of modification symbols being collected, and independent of an award amount determination associated with the collected modification symbols, modifying the plurality of symbols by adding, by the processor, a designated symbol to the plurality of symbols, and following the modification of the plurality of symbols occurring in association with the first symbol generator activation and for a second symbol generator activation having a second average expected payback percentage that is greater than the first average expected payback percentage:

randomly determining, by the processor, a first plurality of the modified plurality of symbols;

causing, by the processor, a display of the first plurality of the modified plurality of symbols by the display device;

determining, by the processor and in accordance with a second, different paytable, any award amounts for the second symbol generator activation based on the first plurality of the modified plurality of symbols; and causing, by the processor, a display of any award amounts for the second symbol generator activation by the display device, wherein the credit balance is increasable based on any award amounts for the second symbol generator activation; and responsive to no modification of the plurality of symbols occurring in association with the first symbol generator activation, providing a third symbol generator activation without modifying the plurality of symbols; and responsive to receipt, by an input device, of a cashout input, initiating, by the processor, a payout associated with the credit balance.

2. The method of claim 1, wherein each of the plurality of symbol generators comprises a set of two or more of the plurality of symbols, and wherein adding, by the processor, the designated symbol to the plurality of symbols comprises adding, by the processor, the designated symbol to the set of symbols of one of the plurality of symbol generators.

3. The method of claim 1, wherein the designated symbol includes a Wild symbol.

4. The method of claim 1, wherein a probability of the first plurality of the modified plurality of symbols comprising a winning symbol combination that comprises the designated symbol is greater than a probability of the first plurality of the plurality of symbols comprising the winning symbol combination.

5. The method of claim 1, further comprising, responsive to the modification of the plurality of symbols occurring in association with the first symbol generator activation, adding, by the processor, multiple designated symbols to the plurality of symbols.

6. The method of claim 1, wherein initiating, by the processor, the payout associated with the credit balance comprises causing, by the processor, a printer to print a redeemable ticket.

7. An electronic gaming machine comprising:

a display device;

a payment acceptor configured to receive a payment input including a physical item;

an input device configured to receive a cashout input, a processor; and a memory device that stores instructions that, when executed by the processor, cause the processor to:

responsive to receipt, by the payment acceptor, of the payment input, establish a credit balance based on a monetary value associated with the payment input;

for a first symbol generator activation, wherein the first symbol generator activation has a first average expected payback percentage and is associated with a plurality of symbol generators comprising a plurality of symbols:

randomly determine a first plurality of the plurality of symbols;

cause a display of the first plurality of the plurality of symbols by the display device;

determine, and in accordance with a first paytable, any award amounts for the first symbol generator activation based on the first plurality of the plurality of symbols; and cause a display of any award amounts for the first symbol generator activation by the display device, wherein the credit balance is increasable based on any award amounts for the first symbol generator activation;

responsive to less than a designated quantity of modification symbols being collected prior to the first symbol generator activation and the first plurality of the plurality of symbols including, independent of any determined award amounts for the first symbol generator activation, a modification symbol that when combined with any modification symbols collected prior to the first symbol generator activation results in at least the designated quantity of modification symbols being collected, and independent of an award amount determination associated with the collected modification symbols, modify the plurality of symbols by adding a designated symbol to the plurality of symbols, following the modification of the plurality of symbols occurring in association with the first symbol generator activation and for a second symbol generator activation having a second average expected payback percentage that is greater than the first average expected payback percentage:

randomly determine a first plurality of the modified plurality of symbols;

cause a display of the first plurality of the modified plurality of symbols by the display device;

determine, and in accordance with a second, different paytable, any award amounts for the second symbol generator activation based on the first plurality of the modified plurality of symbols; and cause a display of any award amounts for the second symbol generator activation by the display device, wherein the credit balance is increasable based on any award amounts for the second symbol generator activation;

responsive to no modification of the plurality of symbols occurring in association with the first symbol generator activation, provide a third symbol generator activation without modifying the plurality of symbols; and responsive to receipt, by the input device, of the cashout input, initiate a payout associated with the credit balance.

8. The electronic gaming machine of claim 7, wherein each of the plurality of symbol generators comprises a set of two or more of the plurality of symbols, and wherein the instructions, when executed by the processor, cause the processor to add the designated symbol to the plurality of symbols by adding the designated symbol to the set of symbols of one of the plurality of symbol generators.

9. The electronic gaming machine of claim 7, wherein the designated symbol includes a Wild symbol.

10. The electronic gaming machine of claim 7, wherein a probability of the first plurality of the modified plurality of symbols comprising a winning symbol combination that comprises the designated symbol is greater than a probability of the first plurality of the plurality of symbols comprising the winning symbol combination.

11. The electronic gaming machine of claim 7, wherein the instructions, when executed by the processor, cause the processor to, responsive to the modification of the plurality of symbols occurring in association with the first symbol generator activation, add multiple designated symbols to the plurality of symbols.

12. The electronic gaming machine of claim 7, wherein the instructions, when executed by the processor, cause the processor to initiate the payout by causing a printer to print a redeemable ticket.

13. A gaming system comprising:

a processor; and a memory device that stores instructions that, when executed by the processor, cause the processor to:

for a first symbol generator activation, wherein the first symbol generator activation has a first average expected payback percentage and is associated with a plurality of symbol generators comprising a plurality of symbols:

randomly determine a first plurality of the plurality of symbols;

cause data to be communicated which results in a display device displaying the first plurality of the plurality of symbols by the display device;

determine, in accordance with a first paytable, any award amounts for the first symbol generator activation based on the first plurality of the plurality of symbols; and cause data to be communicated which results in the display device displaying any award amounts for the first symbol generator activation;

responsive to less than a designated quantity of modification symbols being collected prior to the first symbol generator activation and the first plurality of the plurality of symbols including, independent of any determined award amounts for the first symbol generator activation, a modification symbol that when combined with any modification symbols collected prior to the first symbol generator activation results in at least the designated quantity of modification symbols being collected, and independent of an award amount determination associated with the collected modification symbols, modify the plurality of symbols by adding a designated symbol to the plurality of symbols, and following the modification of the plurality of symbols occurring in association with the first symbol generator activation and for a second symbol generator activation having a second average expected payback percentage that is greater than the first average expected payback percentage:

randomly determine a first plurality of the modified plurality of symbols;

cause data to be communicated which results in the display device displaying the first plurality of the modified plurality of symbols by the display device;

determine, in accordance with a second, different paytable, any award amounts for the second symbol generator activation based on the first plurality of the modified plurality of symbols; and cause data to be communicated which results in the display device displaying any award amounts for the second symbol generator activation; and responsive to no modification of the plurality of symbols occurring in association with the first symbol generator activation, communicate data which results in the display device displaying a third symbol generator activation without modifying the plurality of symbols.

14. The gaming system of claim 13, wherein the display device comprises a display device of a mobile computing device.

* * * * *